US011667146B2

(12) United States Patent
Hayakawa et al.

(10) Patent No.: US 11,667,146 B2
(45) Date of Patent: Jun. 6, 2023

(54) WRITING TOOL

(71) Applicant: KABUSHIKI KAISHA PILOT CORPORATION, Tokyo (JP)

(72) Inventors: Hisatoshi Hayakawa, Tokyo (JP); Tatsuya Iijima, Tokyo (JP); Hisashi Iwata, Tokyo (JP)

(73) Assignee: KABUSHIKI KAISHA PILOT CORPORATION, Tokyo (JP)

( * ) Notice: Subject to any disclaimer, the term of this patent is extended or adjusted under 35 U.S.C. 154(b) by 0 days.

(21) Appl. No.: 17/256,728

(22) PCT Filed: Jun. 27, 2019

(86) PCT No.: PCT/JP2019/025624
§ 371 (c)(1),
(2) Date: Dec. 29, 2020

(87) PCT Pub. No.: WO2020/004555
PCT Pub. Date: Jan. 2, 2020

(65) Prior Publication Data

US 2021/0252903 A1 Aug. 19, 2021

(30) Foreign Application Priority Data

Jun. 29, 2018 (JP) ..... JP2018-125090

(51) Int. Cl.
*B43K 8/12* (2006.01)
*B43K 8/00* (2006.01)
*B43K 23/12* (2006.01)

(52) U.S. Cl.
CPC ..... *B43K 8/12* (2013.01); *B43K 8/003* (2013.01); *B43K 23/12* (2013.01)

(58) Field of Classification Search
CPC ..... B43K 5/005; B43K 7/005; B43K 8/003; B43K 8/12; B43K 11/005; B43K 23/12; F16L 37/025
See application file for complete search history.

(56) References Cited

U.S. PATENT DOCUMENTS 4,455,101 A * 6/1984 Malamoud ..... B43K 5/005 401/258
4,529,328 A * 7/1985 Wacha ..... B43K 7/12 401/116

(Continued)

FOREIGN PATENT DOCUMENTS

JP 2001310588 A 11/2001 ..... B43K 3/00
JP 2004082328 A 3/2004 ..... B43K 27/08

(Continued)

OTHER PUBLICATIONS

International Search Report dated Aug. 13, 2019 in related application No. PCT/JP2019/025624.
European Search Report dated Feb. 21, 2022 for EP19825509.3.

*Primary Examiner* — David P Angwin
*Assistant Examiner* — Bradley S Oliver
(74) *Attorney, Agent, or Firm* — Renner, Kenner

(57) ABSTRACT

In a writing tool 1, a front shaft 5 is detachably provided on a rear shaft 6 containing an ink absorbent body 7. A filling part 51 is provided on an outside surface of a rear part of the front shaft 5. The filling part 51 detachably fits to a fitted part 61 formed on an inside surface of an opening part of the rear shaft 6. The filling part 51 has an outward-facing pressure contact part 53 and a radially penetrating slit 54. The fitted part 61 has an inward-facing pressure contact part 63. The front shaft 5 and the rear shaft 6 are brought into a pressure contact with each other when the front shaft 5 and the rear shaft 6 are fitted to each other.

11 Claims, 22 Drawing Sheets

(56) References Cited

U.S. PATENT DOCUMENTS

| | | | | | |
|---|---|---|---|---|---|
| 4,580,816 | A * | 4/1986 | Campbell | A61M 39/00 | 285/321 |
| 5,217,313 | A * | 6/1993 | Tamura | B43K 7/005 | 401/48 |
| 5,336,009 | A | 8/1994 | Young | 401/209 | |
| 5,368,405 | A * | 11/1994 | Sixiong | B43K 17/00 | 401/35 |
| 6,186,685 | B1 * | 2/2001 | Salemme | B43K 7/005 | 401/6 |
| 6,244,775 | B1 * | 6/2001 | Oike | B43K 11/005 | 401/199 |
| 6,783,295 | B2 * | 8/2004 | Yasunaga | B43K 11/005 | 401/202 |
| 9,586,433 | B2 * | 3/2017 | Malinverni | B43K 7/005 | |
| 11,077,702 | B2 * | 8/2021 | Cauwels | B43K 24/088 | |
| 2003/0049068 | A1 | 3/2003 | Yasunga | 401/202 | |
| 2019/0047319 | A1 | 2/2019 | Malinverni et al. | | |

FOREIGN PATENT DOCUMENTS

| | | | | |
|---|---|---|---|---|
| JP | 2006142559 A | 6/2006 | B43K 23/08 | |
| JP | 2011178000 A | 9/2011 | A45D 34/04 | |
| WO | 2017137696 A1 | 8/2017 | | |

* cited by examiner

WRITING TOOL

CROSS-REFERENCE TO RELATED APPLICATION

This is a § 371 application of International Patent Application No. PCT/JP2019/025624 filed Jun. 27, 2019, which claims the benefit of Japanese Patent Application No. 2018-125090 filed Jun. 29, 2018.

TECHNICAL FIELD

The present invention relates to a writing tool. In details, the present invention relates to a writing tool in which a front shaft is detachably provided on a rear shaft containing an ink absorbent body and in which the ink absorbent body is configured to be replaced or replenished under a state in which the front shaft has been detached from the rear shaft,

BACKGROUND ART

Patent Document 1 has disclosed a writing tool in which a detachable cylinder is detachable from a main cylinder in an axial direction and in which an ink containing body in the main cylinder and/or the detachable cylinder is detachable. One of the main cylinder and the detachable cylinder is provided with a plurality of projections, each of which is projected in a radial direction, partially in a circumferential direction thereof. The other of the main cylinder and the detachable cylinder is provided with a pressure contact surface without unevenness capable of contacting with the plurality of projections. When these two cylinders are connected, the plurality of projections and the pressure contact surface are brought into a pressure contact with each other in the radial direction. According to this writing tool, it is easy to detach the detachable cylinder from the main cylinder. There is no concern that the main cylinder and the detachable cylinder are fitted too tight (too strong) such as when they are threadedly engaged. Therefore, it is easy to replace the ink absorbent body.

PRIOR ART DOCUMENT

Patent Document List

Patent Document 1 is JP-A-2006-142559.

SUMMARY OF INVENTION

Technical Problem

In the structure disclosed in Patent Document 1, the main cylinder and the detachable cylinder are connected (fitted) to each other only by the pressure contact between the plurality of projections and the pressure contact surface. Thus, when the main cylinder and the detachable cylinder consist of resin parts, due to creeping of the resin parts, the fitting force may tend to become smaller than a desired level, which may cause the detachable cylinder to be undesirably detached from the main cylinder. In contrast, due to sticking (blocking) of the resin parts, the fitting force may tend to become larger than a desired level, which may make it difficult to detach the detachable cylinder from the main cylinder by a desired operational force.

The present invention has been made to solve the above conventional problems. The object of the present invention is to provide a writing tool wherein setting and maintenance of an appropriate fitting force for detachably connecting (fitting) a front shaft (corresponding to the detachable cylinder disclosed in Patent Document 1) to a rear shaft (corresponding to the main cylinder disclosed in Patent Document 1) is relatively easy. In the present disclosure, the term "front" means the pen-tip side, and the term "rear" means the opposite side.

Solution to Problem

The present invention is a writing tool in which a front shaft is detachably provided on a rear shaft containing an ink absorbent body, and in which the ink absorbent body is configured to be replaced or replenished under a state in which the front shaft has been detached from the rear shaft, wherein one of a rear part of the front shaft and a front part of the rear shaft has: a smaller-diameter base having a cylindrical shape; an outward-facing pressure contact part protruded radially from an outside surface of the smaller-diameter base; and at least one slit extending in parallel with an axial direction and penetrating the smaller-diameter base in a radial direction in such a pattern that a position in the axial direction of at least a portion of the slit is overlapped with a position in the axial direction of at least a portion of the outward-facing pressure contact part; wherein the other of the rear part of the front shaft and the front part of the rear shaft has: a larger-diameter base having a cylindrical shape whose diameter is larger than that of the smaller-diameter base, into which the smaller-diameter base is configured to be inserted; and an inward-facing pressure contact part provided on an inside surface of the larger-diameter base; and wherein the outward-facing pressure contact part and the inward-facing pressure contact part are configured to be brought into a pressure contact radially with each other when the rear part of the front shaft and the front part of the rear shaft are fitted to each other.

According to the present invention, the at least one slit, which penetrates the smaller-diameter base in the radial direction, extends in parallel with the axial direction, and the position in the axial direction of at least a portion of the slit is overlapped with the position in the axial direction of at least a portion of the outward-facing pressure contact part. Therefore, when the smaller-diameter base is inserted (press-fitted) into the larger-diameter base, the smaller-diameter base can deform in such a manner that a width of the slit can be narrowed, which can make the inserting operation smoother. On the other hand, after the smaller-diameter base has been inserted (press-fitted) into the larger-diameter base, a resilient force is exerted to return the width of the slit, so that the outward-facing pressure contact part and the inward-facing pressure contact part are brought into a pressure contact radially with each other with a sufficient force. Thereby, setting and maintenance of an appropriate fitting force for detachably connecting (fitting) the front shaft to the rear shaft is relatively easy.

Preferably, the outward-facing pressure contact part extends circumferentially except an area in which the slit is provided. In this case, the connection of the front shaft to the rear shaft is made more stable. Thus, good writing feeling and writing performance can be achieved.

In addition, preferably, the outward-facing pressure contact part is provided at a position proximally away from a distal end of the smaller-diameter base by a predetermined distance, and the outside surface of the smaller-diameter base and the inside surface of the larger-diameter base are not in contact radially with each other, at a distal end area of the smaller-diameter base, when the rear part of the front shaft and the front part of the rear shaft are fitted to each other. In this case, high dimensional precision is not necessary except for the pressure contact parts. Thus, the setting and maintenance of the appropriate fitting force for detachably connecting the front shaft to the rear shaft is further facilitated. In addition, productivity of the parts (the front shaft and the rear shaft) is also improved.

In addition, preferably, the smaller-diameter base has an outward-facing engaging part spaced apart from the outward-facing pressure contact part in the axial direction, the larger-diameter base has an inward-facing engaging part spaced apart from the inward-facing pressure contact part in the axial direction, and the outward-facing engaging part and the inward-facing engaging part are engaged with each other with respect to the axial direction when the rear part of the front shaft and the front part of the rear shaft are fitted to each other. In this case, an engagement (locking) function between the front shaft and the rear shaft with respect to the axial direction is added. Thus, the connection of the front shaft to the rear shaft is made more stable, and better writing feeling and writing performance can be achieved.

In addition, in this case, more preferably, the outward-facing pressure contact part extends circumferentially except an area in which the slit is provided, the inward-facing pressure contact part extends circumferentially such that the inward-facing pressure contact part is configured to be brought into a pressure contact radially with the outward-facing pressure contact part, the outward-facing engaging part extends circumferentially except an area in which the slit is provided, and the inward-facing engaging part extends circumferentially such that the inward-facing engaging part is configured to be engaged with the outward-facing engaging part with respect to the axial direction. In the case wherein this feature is adopted, the connection of the front shaft to the rear shaft is made much more stable, and much better writing feeling and writing performance can be achieved.

In addition, in this case, the inward-facing engaging part is radially concavely provided on the inside surface of the larger-diameter base, and the inward-facing pressure contact part consists of a cylindrical surface which is smoothly continuous to the inside surface of the larger-diameter base and has the same curvature as that of the inside surface of the larger-diameter base. In this case, no special machining or processing is required for the inward-facing pressure contact part. Thus, productivity of the parts is improved.

Alternatively, preferably, the outward-facing pressure contact part and the inward-facing pressure contact part are configured to be engaged with each other with respect to the axial direction when the rear part of the front shaft and the front part of the rear shaft are fitted to each other. In this case as well, an engagement (locking) function between the front shaft and the rear shaft with respect to the axial direction is added. Thus, the connection of the front shaft to the rear shaft is made more stable, and better writing feeling and writing performance can be achieved.

In addition, it is preferable that there is provided a cap configured to cover the front shaft when the writing tool is not used for writing, and that a portion of an inside surface of the cap is configured to be brought into a close contact with an entire circumference of a portion of an outside surface of the rear shaft. In this case, there is no possibility that the front shaft is detached when the cap is detached. Therefore, it is not necessary to strongly fit the front shaft to the rear shaft, and thus the setting of the appropriate fitting force between the front shaft and the rear shaft is much more facilitated. In addition, in general, the shape or outer diameter of the outside surface of the rear shaft is stable, so that an assured air-tight performance can be achieved when the inside surface of the cap and the outside surface of the rear shaft are fitted to each other.

In addition, preferably, when the front shaft is detached from the rear shaft, the ink absorbent body is also detached from the rear shaft and held in the front shaft. In this case, the operability in replacing the ink absorbent body or the operability in replenishing the ink absorbent body can be improved.

In addition, preferably, the slit is opened on a distal end side of the smaller-diameter base, and the slit is tapered proximally from the distal end side of the smaller-diameter base. In this case, when the smaller-diameter base is inserted (press-fitted) into the larger-diameter base, a relatively wide portion of the slit on the distal end side is used. On the other hand, after the smaller-diameter base has been inserted (press-fitted) into the larger-diameter base, because of a relatively narrow portion of the slit on a proximal side, high rigidity against a bending force is provided. In addition, when such a shape of the slit is adopted, the front shaft can be manufactured by means of a slidable mold, which can reduce the manufacturing costs thereof.

In addition, preferably, the number of the slits is an odd number of three or more, and the slits are provided at substantially regular circumferential intervals. In this case, even if the width of each slit is narrowed, the operability in fitting the smaller-diameter base into the larger-diameter base is maintained high. In addition, when the width of each slit is narrowed, rigidity against a bending force is made higher.

In addition, preferably, there is provided a rib, configured to be inserted into the slit, on the inside surface of the larger-diameter base. In this case, rigidity against a bending force is made higher. In addition, a function of preventing a relative rotation between the front shaft and the rear shaft can be added.

Advantageous Effects of Invention

According to the writing tool of the present invention, setting and maintenance of an appropriate fitting force for detachably connecting (fitting) the front shaft to the rear shaft is relatively easy.

DESCRIPTION OF EMBODIMENTS

Figure 1:
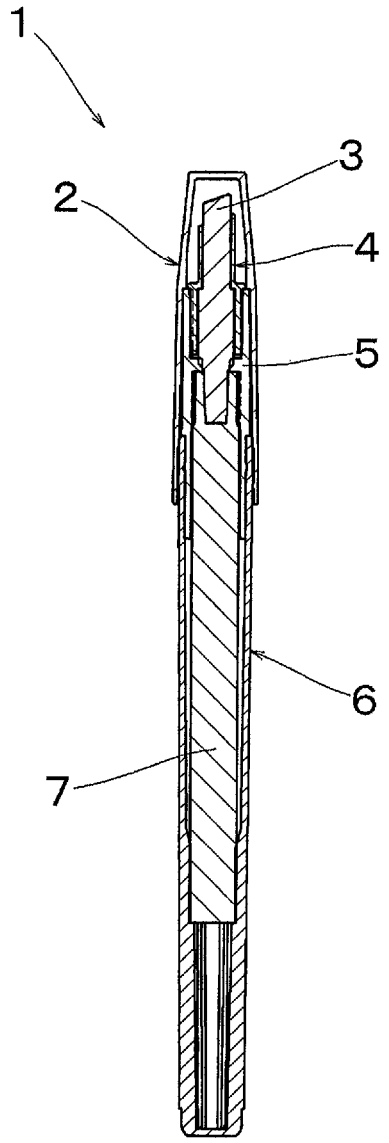
FIG. 1 is a longitudinal section view showing a first embodiment of the present invention.

With reference to the drawings, six embodiments of the present invention are explained.

First Embodiment

A writing tool 1 mainly consists of: a cap 2; a pen tip 3; a holding member 4 holding the pen tip 3; an ink absorbent body 7; a front shaft 5 containing the ink absorbent body 7 therein; and a rear shaft 6. The holding member 4 is press-fitted into a holding-member fitting part 58 of the front shaft 5. The writing tool 1 is a writing tool in which the front shaft 5 is detachably provided on the rear shaft 6 containing the ink absorbent body 7, and in which the ink absorbent body 7 is configured to be replaced or replenished under a state in which the front shaft 5 has been detached from the rear shaft 6.

<Pen Tip>

As a writing element 31, a one end of the pen tip 3 is projected forward from a front edge 44 of a front opening part of the holding member 44. The other end (rear part 35) of the pen tip 3 is stuck in and connected to a front portion of the ink absorbent body 7. For example, the writing element 31 is machined or processed into a chisel shape. However, not limited to a chisel shape, the writing element 31 may be machined or processed into another shape, such as a shell (torpedo) shape, a rectangular parallelepiped shape, another square pole shape, a tabular shape, or the like, depending on the purpose. The writing tool of the present invention may not be limited to the shown embodiment, but may be a double-headed writing tool in which different pen tips are attached to both ends of the ink absorbent body 7.

Figure 2:
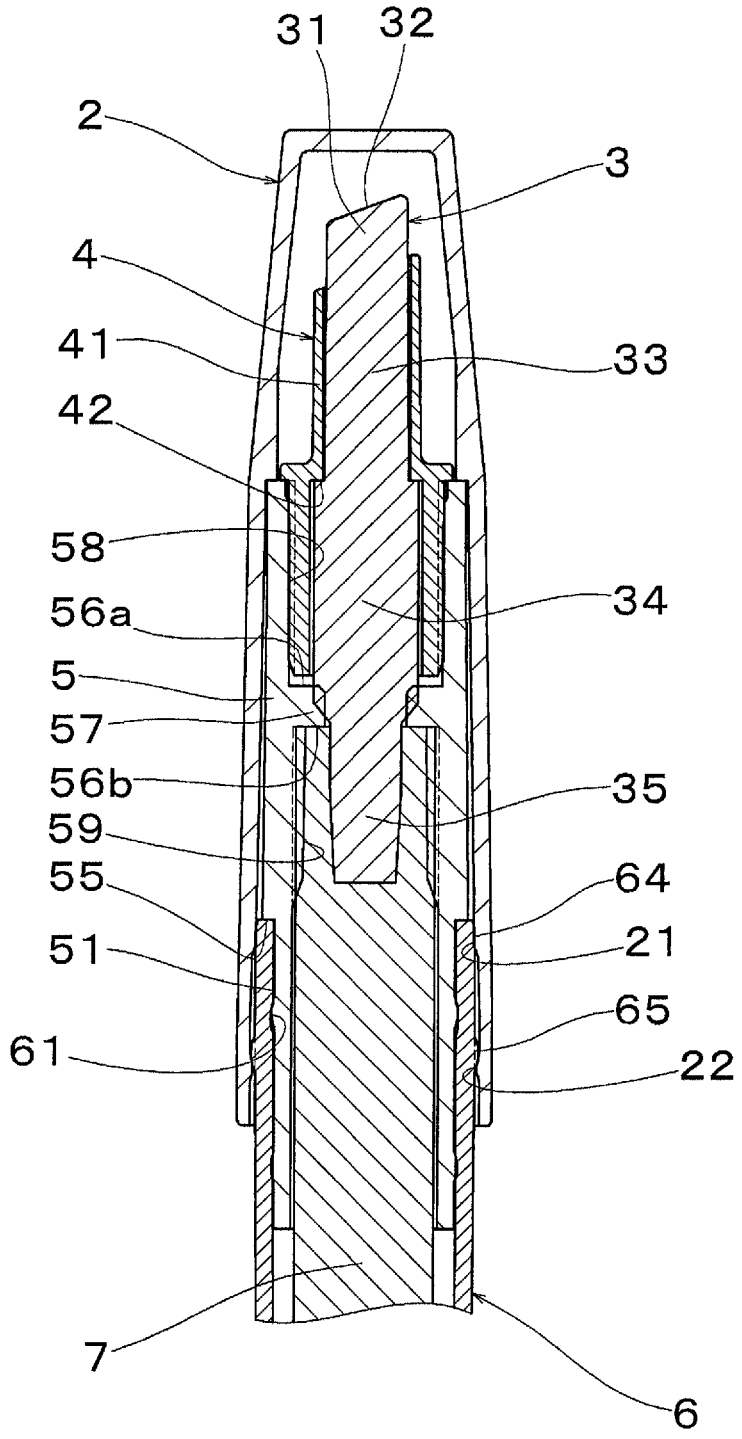
FIG. 2 is an enlarged view of a main part of FIG. 1.
Figure 4A:
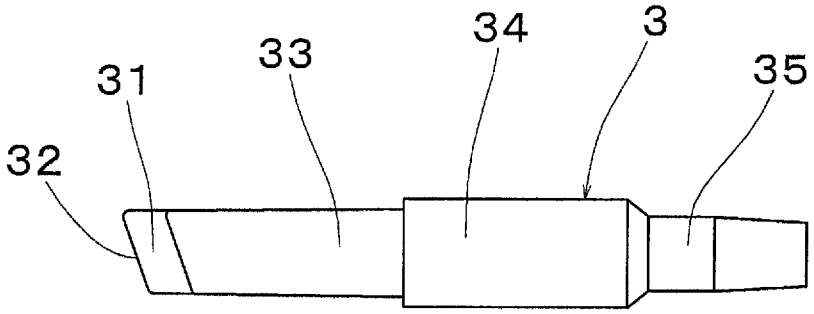
FIG. 4A is a front view of a pen tip in the first to the sixth embodiments of the present invention.
Figure 4B:
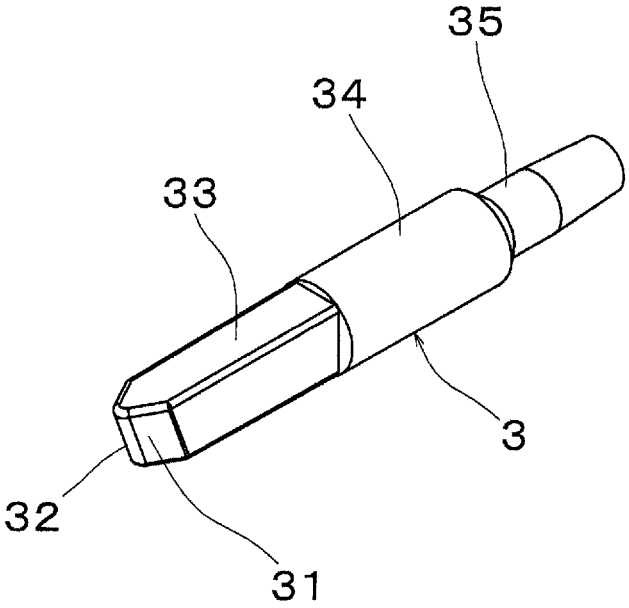
FIG. 4B is a perspective view of the pen tip of FIG. 4A.
Figure 5:
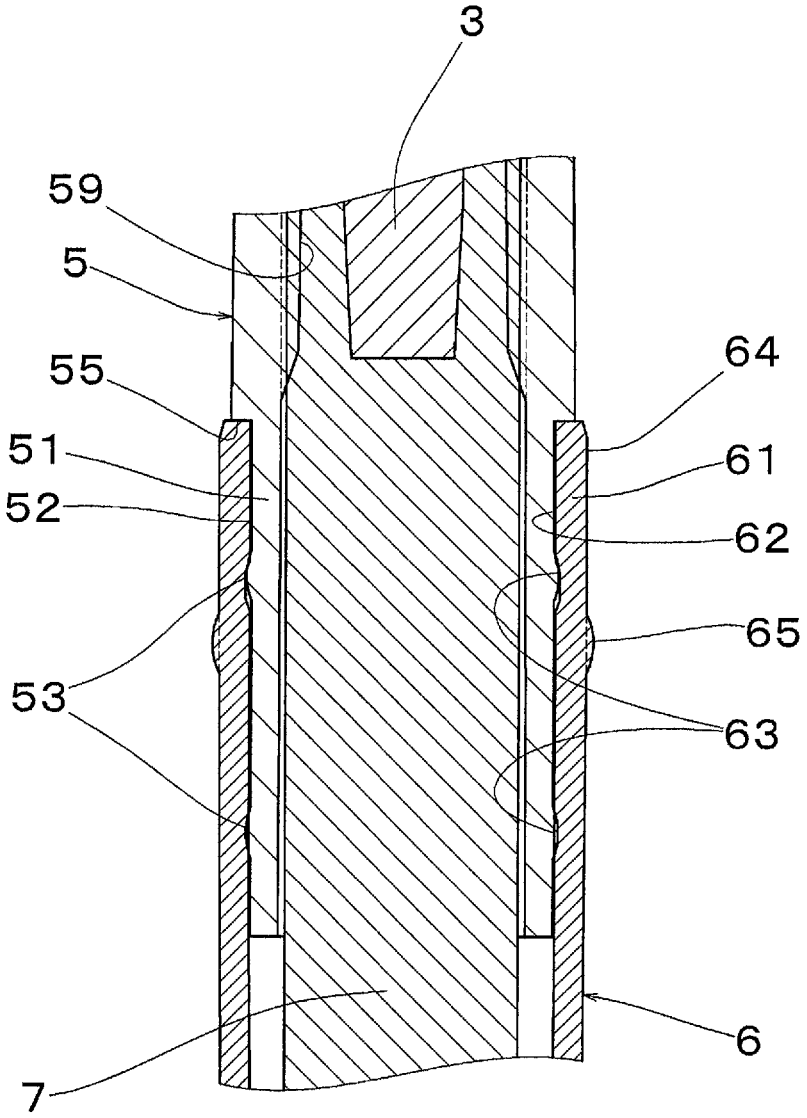
FIG. 5 is an enlarged longitudinal section view of a main part of FIG. 2.

As shown in FIGS. 2 and 4, the pen tip 3 has: a front part 33 having the writing element 31 at a distal end thereof, a cylindrical middle part 34 whose outside surface is held in a front-back direction by the holding member 4 and the front shaft 5, and a cylindrical rear part 35 stuck on and connected to the front portion of the ink absorbent body 7. The front part 33 of the pen tip 3 has a transversal cross section of a substantially rectangular shape. When the writing tool 1 is used for writing, the front part 33 of the pen tip 3 can bend along a long-side of the substantially rectangular cross section (such flexibility is provided).

The pen tip 3 consists of a porous body made of synthetic resin, which has an open-cell structure. However, the pen tip 3 may be of another type as long as it is ink-distributable and flexible. Specifically, a fabric pen tip, a felt pen tip, a brush pen tip, a plastic pen tip having capillary channels extending in an axial direction, or the like may be raised as examples.

<Ink Absorbent Body>

The ink absorbent body 7 consists of an ink-impregnatable member having an open-cell structure. For example, a thermally bonded body of a bundle of fabric, a resin processed body of a bundle of fabric, a resin processed body of a felt, a needle-punching processed body of a felt, a porous body (for example, an open-cell body made of synthetic resin, such as a sponge), or the like may be raised as examples. In addition, the ink absorbent body 7 may have an outer cover consisting of a synthetic resin film or the like, on the outside surface thereof.

When the front shaft 5 is detached from the rear shaft 6, the ink absorbent body 7 is also detached from the rear shaft 6 under a state in which the ink absorbent body 7 is held by holding ribs 59, which extend rearward in the axial direction from rear ends of longitudinal ribs 57 of the front shaft 5. Then, the ink absorbent body 7 is held in the front shaft 5. Thereby, the operability in replacing the ink absorbent body 7 or the operability in replenishing the ink absorbent body 7 is improved. The holding ribs 59 may extend as far as onto an inside surface of a fitting part 51 of the front shaft 5.

<Cap>

A cap 2, which is configured to cover the front shaft 5 when the writing tool 1 is not used for writing, is a bottomed cylindrical body consisting of a bottom wall and a surrounding side wall, wherein a rear end thereof is opened and a front end thereof is closed. For example, the cap 2 can be made of synthetic resin (such as polypropylene) by an injection molding.

The cap 2 of the present embodiment is detachably connected to the rear shaft 6. Specifically, a rear-shaft fitting part 22 provided on an inside surface of the cap 2 is fitted to a cap fitting part 65 provided on an outside surface of the rear shaft 6. At the same time, an annular sealing part 21 provided at a front portion of the rear-shaft fitting part 22 is air-tightly fitted to a sealing part 64 provided at a front portion of the cap fitting part 65. That is, the cap 2 is configured to cover the front shaft 5 when the writing tool 1 is not used for writing, a portion of the inside surface of the cap 2 (the rear-shaft fitting part 22) is fitted to a portion of the outside surface the rear shaft 6 (the cap fitting part 65), and another portion of the inside surface of the cap 2 (the annular sealing part 21) is brought into a close contact with an entire circumference of another portion of the outside surface of the rear shaft 6 (the sealing part 64).

Herein, as shown in the drawings of the Patent Document 1, when three projections are provided at predetermined intervals, a transversal cross section shape of the main cylinder under a state in which the detachable cylinder is fitted thereto, is a shape similar to a triangle shape. In this case, it is possible that an appropriate air-tight performance between the cap and the close contact parts of the main cylinder is not assured, which may cause the pen tip to dry up, which may deteriorate the writing performance.

According to the present embodiment, in order to solve this problem, as described below in details, each of outward-facing functioning parts of the front shaft 5 (the outward-facing engaging part 53*a* and the outward-facing pressure contact part 53*b*) and inward-facing functioning parts of the rear shaft 6 (the inward-facing engaging part 63*a* and the inward-facing pressure contact part 63*b*) extends continuously circumferentially. Thus, under a state in which the front shaft 5 and the rear shaft 6 are fitted to each other, a transversal cross section shape of the outside surface of the rear shaft 6 is substantially a circle. Thus, an appropriate air-tight performance between the cap 2 and the rear shaft 6 can be achieved.

<Front Shaft>

The front shaft 5 is a tubular body, the both ends of which are opened. For example, the front shaft 5 can be made of synthetic resin by an injection molding. As shown in FIG. 2, a holding-member fitting part 58, to which an outside surface of a rear portion of the holding member 4 (second ribs 43*b*: see FIG. 3) is press-fitted, is formed on an inside surface of a front portion of the front shaft 5. A plurality of (eight in the present embodiment) longitudinal ribs 57 extending in the axial direction are formed at circumferential regular intervals at the rear of the holding-member fitting part 58 of the front shaft 5. The middle part 34 of the pen tip 3 is held in the front-back direction by a first contact wall 42 of the holding member 4 and second contact walls 56*a* on a front side of the longitudinal ribs 57. Thereby, it can be prevented that the pen tip 3 falls off the holding member 4 and/or that the pen tip 3 sinks into the holding member 4. In addition, the projection amount of the pen tip 3 from the holding member 4 can be accurately controlled. Third contact walls 56*b* on a rear side of the longitudinal ribs 57 control the front portion of the ink absorbent body 7 in the front-back direction.

Figure 6A:
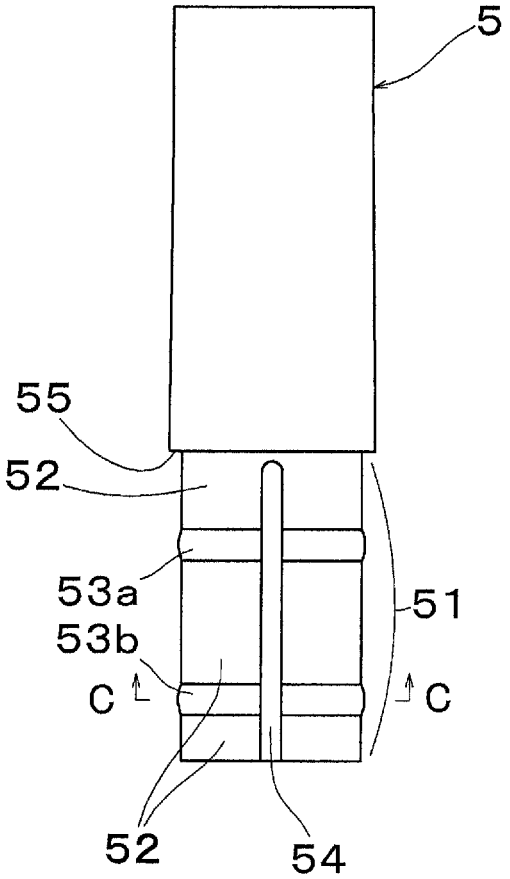
FIG. 6A is a front view of a front shaft in the first embodiment of the present invention.

A rear portion of the front shaft 5 forms a fitting part 51, which is configured to detachably fit to a fitted part 61 of an opening part of the rear shaft 6. As shown in FIG. 6A, the fitting part 51 has: a smaller-diameter base 52 having a cylindrical shape; an outward-facing engaging (locking) part 53*a* protruded radially from an outside surface of the smaller-diameter base 52; an outward-facing pressure contact part 53*b* spaced apart from the outward-facing engaging part 53*a* in the axial direction and protruded radially from the outside surface of the smaller-diameter base 52 similarly to the outward-facing engaging part 53*a*; and one slit 54 extending in parallel with the axial direction and penetrating the smaller-diameter base 52 in the radial direction. The outward-facing engaging part 53*a* extends circumferentially (annularly except an area in which the slit 54 is provided). In the same way, the outward-facing pressure contact part 53*b* extends circumferentially (annularly except an area in which the slit 54 is provided). The slit 54 is formed in such a pattern that a position in the axial direction of a portion of the slit 54 is overlapped with a position in the axial direction of the outward-facing engaging part 53*a* and a position in the axial direction of another portion of the slit 54 is overlapped with a position in the axial direction of the outward-facing pressure contact part 53*b* (the slit 54 is formed in such a pattern that the slit 54 lies across the outward-facing engaging part 53*a* and the outward-facing pressure contact part 53*b*).

According to the above structure, when the smaller-diameter base 52 is inserted (press-fitted) into a larger-diameter base 62 (see FIG. 6B), the smaller-diameter base 52 can deform in such a manner that a width of the slit 54 can be narrowed, which can make the inserting operation smoother. On the other hand, after the smaller-diameter base 52 has been inserted (press-fitted) into the larger-diameter base 62, a resilient force is exerted to return the width of the slit 54, so that the outward-facing pressure contact part 53*b* and an inward-facing pressure contact part 63*b* (see FIG. 6B) are brought into a pressure contact radially with each other with a sufficient force. Thereby, setting and maintenance of an appropriate fitting force for detachably connecting (fitting) the front shaft 5 to the rear shaft 6 is relatively easy.

In the present embodiment, the outward-facing pressure contact part 53*b* is provided on the rear side of the outward-facing engaging part 53*a* (closer to a distal end of the smaller-diameter base 52). In addition, the front shaft 5 has a step part 55, which is configured to abut with the opening part of the rear shaft 6.

The front shaft 5 may have an orientation identifying part for identifying an orientation of the pen tip 3. For example, the orientation identifying part may be provided as a projection extending in the axial direction. In this case, it is not necessary to confirm the orientation of the pen tip 3 by visual inspection just before starting to write, and thus it is possible to start to write just after the pen tip 3 is exposed.

As a specific dimensional example, the length of the smaller-diameter base 52 (the length measured from the step part 55) may be 15 mm, the inner diameter of the smaller-diameter base 52 may be φ 7.2 mm, and the outer diameter of the smaller-diameter base 52 may be φ 8.8 mm. The length of the slit 54 may be 14.5 mm, and the width of the slit 54 may be uniform and 1 mm. The outward-facing engaging part 53*a* may be formed circumferentially (annularly except the area in which the slit 54 is provided) as a protruded part (whose height from the smaller-diameter base 52 is 0.15 mm), which may have an arc-shaped cross section, in an area of 3.8 mm to 5.2 mm from the step part 55 in the axial direction. The outward-facing pressure contact part 53*b* may be formed circumferentially (annularly except the area in which the slit 54 is provided) as a protruded part (whose height from the smaller-diameter base 52 is 0.15 mm), which may have an arc-shaped cross section, in an area of 11.3 mm to 12.7 mm from the step part 55 in the axial direction.

<Rear Shaft>

The rear shaft 6, which is configured to be detachably connected to the rear portion of the front shaft 5, is a bottomed cylindrical body consisting of a bottom wall and a surrounding side wall, wherein a front end thereof is opened and a rear end thereof is closed. For example, the rear shaft 6 can be made of synthetic resin (such as polypropylene) by an injection molding.

Figure 6B:
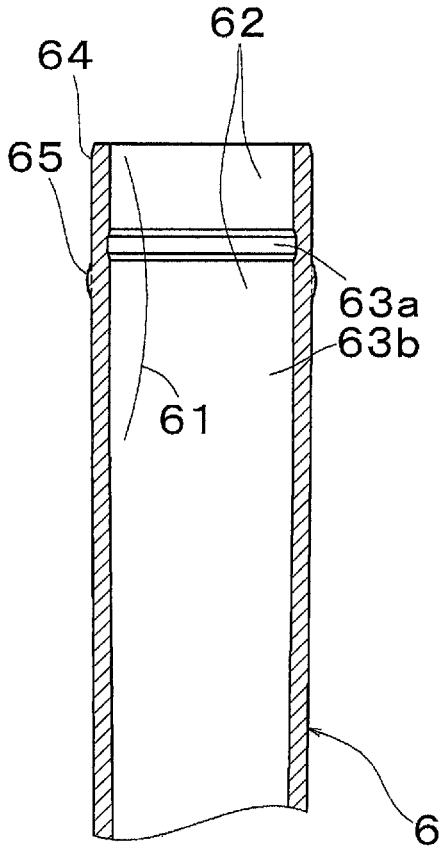
FIG. 6B is a longitudinal section view of a rear shaft in the first embodiment of the present invention.
Figure 6C:
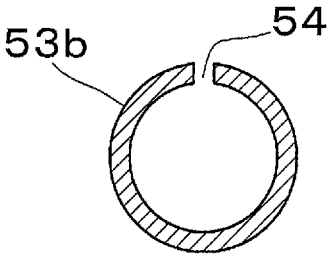
FIG. 6C is a cross section view taken along line C-C of FIG. 6A.

As shown in FIG. 6B, the fitted part 61 has: a larger-diameter base 62 having a cylindrical shape, whose diameter is larger than that of the smaller-diameter base 52 and into which the smaller-diameter base 52 is configured to be inserted; an inward-facing engaging part 63*a* radially concavely provided on the inside surface of the larger-diameter base 62; and an inward-facing pressure contact part 63*b* consisting of a cylindrical surface, which is smoothly continuous to the inside surface of the larger-diameter base 62 and has the same curvature as that of the inside surface of the larger-diameter base 62.

In the present embodiment, the inward-facing pressure contact part 63*b* is provided on the rear side of the inward-facing engaging part 63*a*.

In addition to the function that the outward-facing pressure contact part 53*b* and the inward-facing pressure contact part 63*b* (see FIG. 6B) are brought into a pressure contact radially with each other with a sufficient force, due to another function that the outward-facing engaging part 53*a* and the inward-facing engaging part 63*a* (see FIG. 6B) are engaged (locked) with each other in the axial direction, the front shaft 5 and the rear shaft 6 are connected without "rattling" both in the radial direction and in the axial direction. Thus, a stable writing performance with a good writing taste (writing feeling) can be achieved.

In addition, in the present embodiment, the outward-facing pressure contact part 53*b* is provided at a position proximally (forwardly) away from the distal end of the smaller-diameter base 52 by a predetermined distance. Thus, the outside surface of the fitting part 51 (the outside surface of the smaller-diameter base 52) and the inside surface of the distal end of the rear shaft 6 (the inside surface of the larger-diameter base 62) are not in contact radially with each other, at a distal end area of the smaller-diameter base 52, when the front shaft 5 and the rear shaft 6 are fitted to each other.

If the outside surface of the fitting part 51 and the inside surface of the distal end of the rear shaft 6 are in contact radially with each other at the distal end area of the smaller-diameter base 52 when the front shaft 5 and the rear shaft 6 are fitted to each other, the outer diameter of the rear shaft 6 after connected to the front shaft 5 (that is, the outer diameter of the sealing part 64) may become too large. In such a situation, if the cap 2 is fitted on the outside surface of the rear shaft 6, the fitting force between the cap 2 and the rear shaft 6 may become too high (too tight).

However, according to the present embodiment, the outside surface of the fitting part 51 and the inside surface of the distal end of the rear shaft 6 are not in contact radially with each other at the distal end area of the smaller-diameter base 52 when the front shaft 5 and the rear shaft 6 are fitted to each other. Thus, the fitting part 51 does not affect the dimension of the outer diameter of the sealing part 64. Therefore, high dimensional precision for the smaller-diameter base 52 is not necessary except for the outward-facing pressure contact par 53*b* (and the outward-facing engaging part 53*a*), and the setting and maintenance of the appropriate fitting force for detachably connecting the front shaft 5 to the rear shaft 6 is further facilitated. In addition, productivity of the parts (the front shaft 5 and the rear shaft 6) is also improved. Furthermore, in general, the shape or outer diameter of the outside surface of the rear shaft 6 is stable, so that an assured air-tight performance and fitting force can be achieved when the inside surface of the cap 2 and the outside surface of the rear shaft 6 are fitted to each other.

In addition, in the present embodiment, the inward-facing engaging part 63*a* is formed as an annular groove capable of engaging with the outward-facing engaging part 53*a*. On the other hand, the inward-facing pressure contact part 63*b* is formed as a pressure contact surface without unevenness capable of contacting with the outward-facing pressure contact part 53*b* (as a cylindrical surface smoothly continuous to the inside surface of the larger-diameter base 62 and having the same curvature as that of the inside surface of the larger-diameter base 62). Thus, when the front shaft 5 and the rear shaft 6 are fitted to each other, the opening part of the rear shaft 6 and the step part 55 are abutted with each other, the outward-facing engaging part 53*a* and the inward-facing engaging part 63*a* (annular groove) are engaged with each other in the axial direction, and the outward-facing pressure contact part 53*b* and the inward-facing pressure contact part 63*b* (pressure contact surface) are brought into pressure contact with each other in the radial direction. That is to say, the front shaft 5 and the rear shaft 6 are fitted at their appropriate engagement positions. Thus, an appropriate fitting force for detachably connecting the front shaft 5 to the rear shaft 6 can be achieved more surely. In addition, the user can easily recognize that the front shaft 5 and the rear shaft 6 have been normally connected.

Regarding this matter, according to the structure disclosed in Patent Document 1, it is not easy to provide a click feeling when fitting the main cylinder and the detachable cylinder. That is to say, the structure has a drawback that it cannot give a user a sense of security in the fact that the main cylinder and the detachable cylinder have been normally connected.

In contrast, according to the present embodiment, a click feeling can be provided when fitting the front shaft 5 and the rear shaft 6. Thus, the present embodiment can give a user a sense of security in the fact that the front shaft 5 and the rear shaft 6 have been normally connected.

In addition, the outward-facing engaging part 53*a* and the inward-facing engaging part 63*a* are engaged with each other in the axial direction, and the outward-facing pressure contact part 53*b* and the inward-facing pressure contact part 63*b* are brought into pressure contact with each other in the radial direction. This means that the front shaft 5 and the rear shaft 6 interact with each other at two positions in the axial direction. Thus, when the writing tool 1' is used for writing, the front shaft 5 and the rear shaft 6 are connected without "rattling" both in the axial direction and in the radial direction. Thus, a stable writing performance with a good writing taste (writing feeling) can be achieved.

As a specific dimensional example, the inner diameter of the larger-diameter base 62 may be φ 8.9 mm, and the outer diameter of the larger-diameter base 62 may be φ 10.7 mm. The inward-facing engaging part 63*a* may be formed circumferentially as a concaved part (whose maximum depth is 0.15 mm), which may have a trapezoidal cross section or an arc-shaped cross section, in an area of 4.1 mm to 5.5 mm from the distal end (front end) of the larger-diameter base 62 in the axial direction. The cap fitting part 65 may be formed as four protrusions (whose protruded height is 0.3 mm), each of which may have an arc-shaped cross section, in an area of 8.6 mm to 10.4 mm from the distal end of the larger-diameter base 62 in the axial direction, discretely at substantially regular circumferential intervals.

<Holding Member>

The holding member 4 is a tubular body, the both ends of which are opened. For example, the holding member 4 can be made of synthetic resin by an injection molding.

Figure 3A:
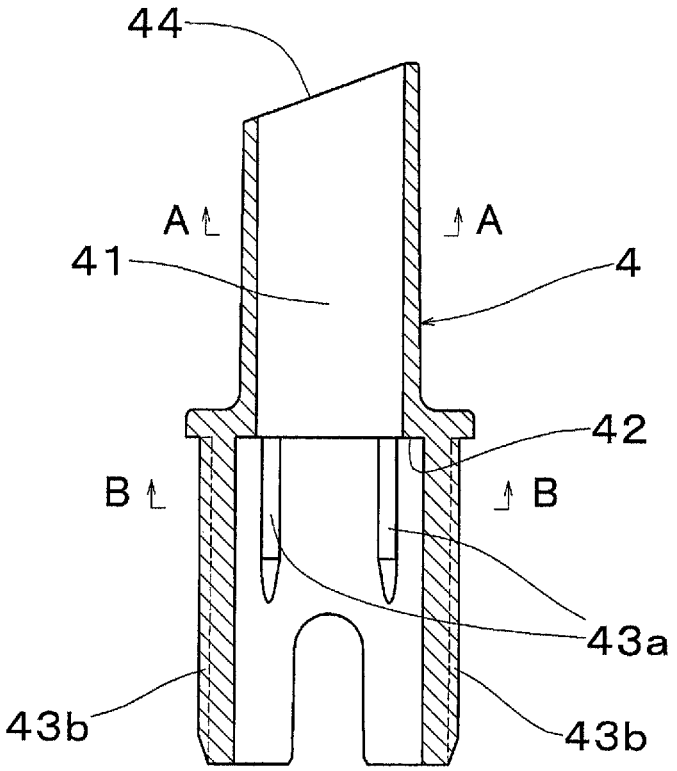
FIG. 3A is a longitudinal section view of a holding member in the first to sixth embodiments of the present invention.
Figure 3B:
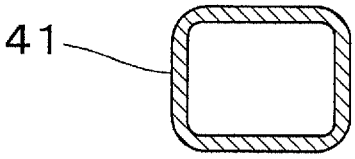
FIG. 3B is a cross section view taken along line A-A of FIG. 3A.
Figure 3C:
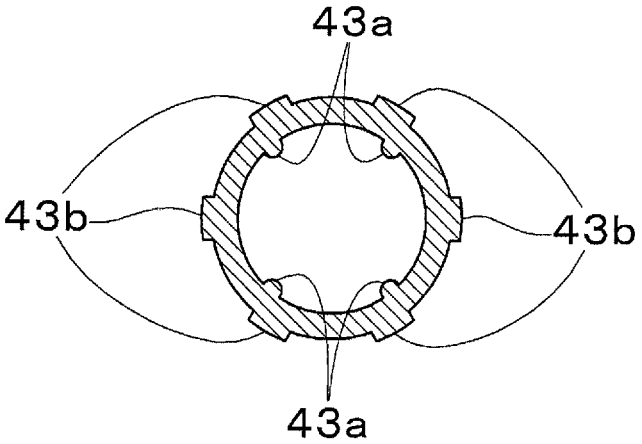
FIG. 3C is a cross section view taken along line B-B of FIG. 3A.

As shown in FIGS. 3A to 3C, a plurality of (four in the present embodiment) first ribs 43*a* extending in the axial direction, into which the middle part 34 of the pen tip 3 is configured to be press-fitted, are formed on the inside surface (having a transversal cross section of a circular shape) of the rear portion of the holding member 4. On the other hand, a plurality of (six in the present embodiment) second ribs 43*b* extending in the axial direction, which are configured to be press-fitted to the holding-member fitting part 58 of the front shaft 5, are formed at circumferential regular intervals on the outside surface (having a transversal cross section of a circular shape) of the rear portion of the holding member 4. Herein, communication holes are formed by the second ribs 43*b* and the holding-member fitting part 58 of the front shaft 5, and the communication holes serve as air communication holes to enable ink to be smoothly discharged from the pen tip 3.

In addition, with reference to FIG. 2 as well, the holding member 4 has, on a front side thereof, a holding part 41 having a transversal cross section of a substantially rectangular shape and surrounding the front part 33 of the pen tip 3. The writing element 31 is projected forwardly from the front edge 44 of the holding part 41 of the holding member 4.

A top part 32 of the pen tip 3 is projected forwardly from the front edge 44 of the holding member 4. It is effective that the projection amount is larger than 0.2 mm and smaller than 6.0 mm, preferably larger than 1.0 mm and smaller than 5.0 mm. In such a preferable range, if the projection amount is smaller, a rigid type of writing feeling can be obtained, and if the projection amount is larger, a soft type of writing feeling can be obtained.

The front edge 44 of the holding member 4 is chamfered or rounded. In particular, it is preferable that at least the edge on the side of the pen tip 3, with which the pen tip 3 may come into contact, is chamfered or rounded. Thereby, even if the pen tip 3 flexes so excessively that the pen tip 3 comes into contact with the front edge 44 of the holding member 4, a load applied to the front part 33 of the pen tip 3 can be minimized. Thus, breaking or damage of the pen tip 3 can be prevented more surely.

As shown in FIGS. 2 and 3A, the front edge 44 of the holding member 4 is formed substantially straightly, the top part 32 of the writing element 31 is also formed substantially straightly, and an angle of the front edge 44 of the holding member 4 with respect to the axial direction is substantially the same as an angle of the top part 32 of the writing element 31 with respect to the axial direction. Thus, the load applied to the pen tip 3 by the front edge 44 of the holding member 4 when the pen tip 3 flexes excessively is uniformly applied to the entire front part 33 of the pen tip 3. Because of this reason too, the breaking or damage of the pen tip 3 can be prevented more surely.

Herein, the angle of the front edge 44 of the holding member 4 with respect to the axial direction means an angle not larger than 90 degrees among angles which the front edge 44 of the holding member 4 forms with the axial direction, and the angle of the top part 32 of the writing element 31 with respect to the axial direction means an angle not larger than 90 degrees among angles which the top part 32 of the writing element 31 forms with the axial direction. In addition, the condition wherein these two angles are substantially the same means that the front edge 44 of the holding member 4 and the top part 32 are substantially parallel with each other. These angles are set not smaller than 30 degrees and not larger than 90 degrees, preferably not smaller than 45 degrees and not larger than 90 degrees, As shown in FIG. 2, when the entire writing tool 1 is seen in a direction along an extending line of a short side of the writing element 31 in contact with a paper surface, the shape of the pen tip 3 exposed from the holding member 4 is a substantially parallelogram or a substantially rectangle. Therefore, the shape and orientation of the writing element 31 can be recognized by the shape of the front edge 44. Thus, it is not necessary to confirm the orientation of the pen tip 3 by direct visual inspection just before starting to write, and thus it is possible to start to write just after the pen tip 3 is exposed.

In addition, it is preferable that the color of the holding member 4 is different from the color of the pen tip 3 (i.e., the color of the ink). In this case, the orientation of the front edge 44 is clearer, so that it is easier to recognize the shape and orientation of the writing element 31. For example, when the pen tip 3 is colored by a dark color such as black and the holding member 4 is colored by a bright color different from the color of the pen tip 3, the orientation of the front edge 44 is much clearer, so that it is much easier to recognize the shape and orientation of the writing element 31.

The structure for detachably fitting the front shaft 5 to the rear shaft 6 according to the present embodiment may be applicable to the structure for fitting the holding member 4 to the front shaft 5. In this case, the holding member 4 may be detachably fitted to the front shaft 5 with an appropriate fitting force, which can give a user a comfortable feeling. In addition, the user can easily recognize that the holding member 4 and the front shaft 5 have been normally connected, and thereby an operation of replacing the pen tip can be facilitated.

Second Embodiment

Figure 7:
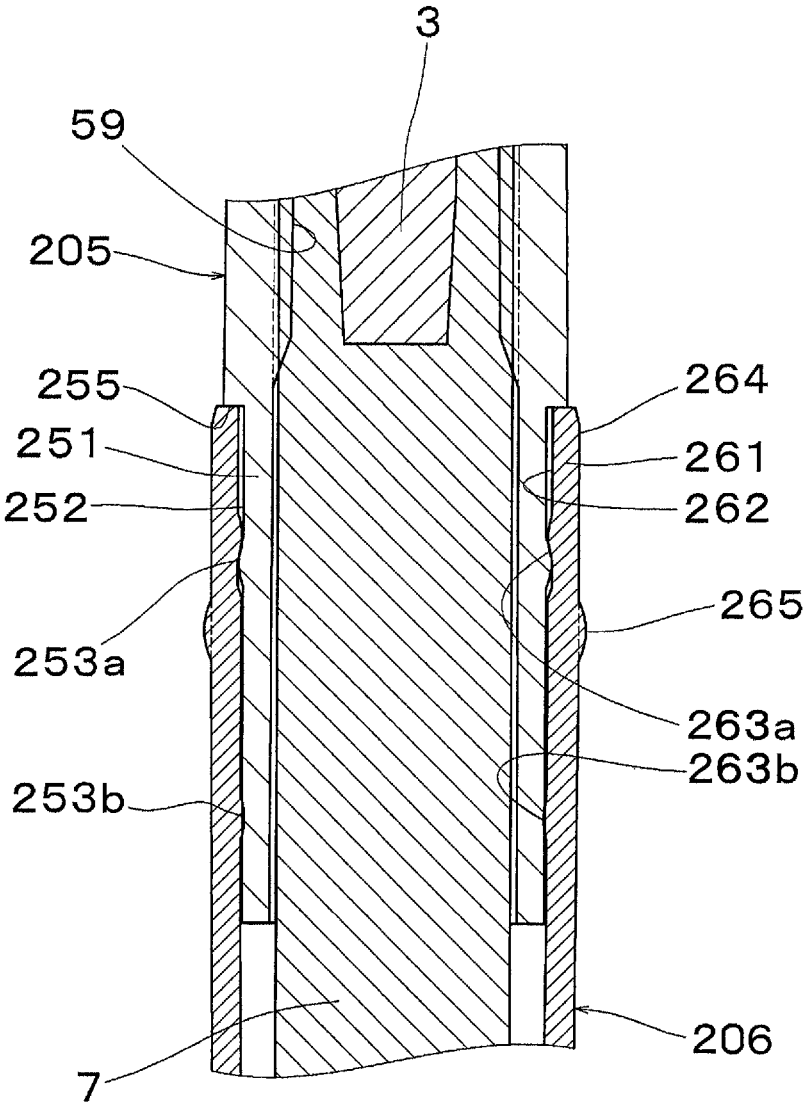
FIG. 7 is an enlarged longitudinal section view of a main part of the second embodiment of the present invention.
Figure 8A:
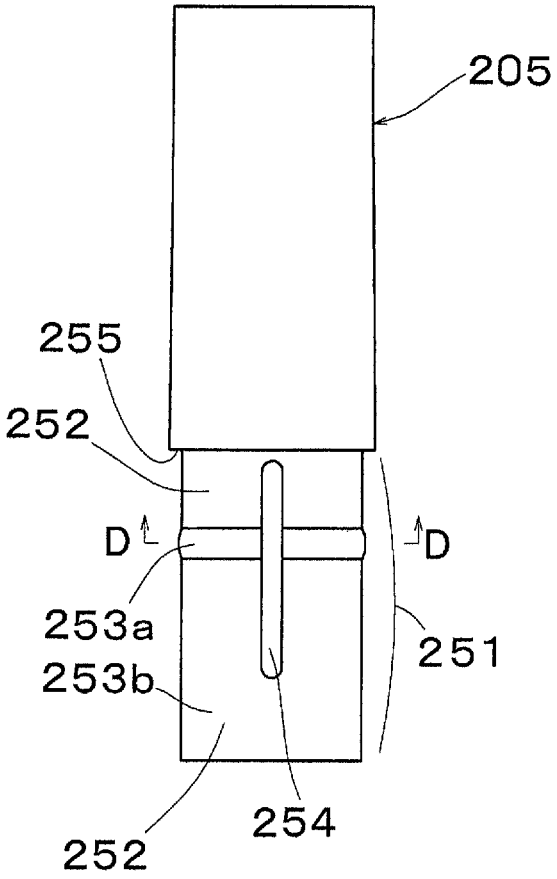
FIG. 8A is a front view of a front shaft in the second embodiment of the present invention.
Figure 8B:
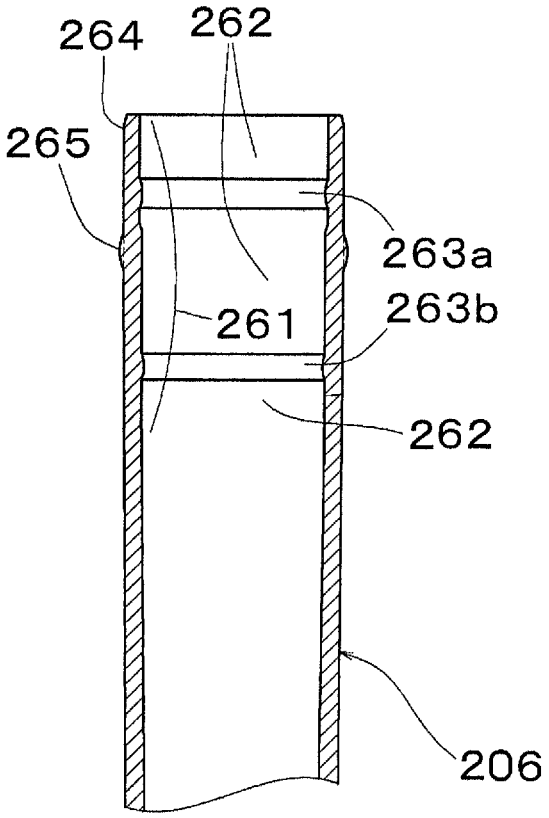
FIG. 8B is a longitudinal section view of a rear shaft in the second embodiment of the present invention.
Figure 8C:
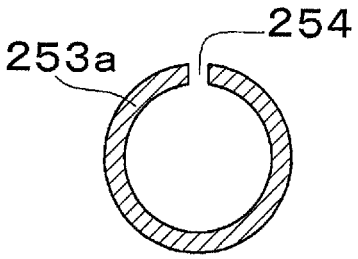
FIG. 8C is a cross section view taken along line D-D of FIG. 8A.

FIG. 7 is an enlarged longitudinal section view of a main part of the second embodiment of the present invention. FIG. 8A is a front view of a front shaft in the second embodiment of the present invention. FIG. 8B is a longitudinal section view of a rear shaft in the second embodiment of the present invention. FIG. 8C is a cross section view taken along line D-D of FIG. 8A.

In the second embodiment of the present invention, both a fitting part 251 of a front shaft 205 and a fitted part 261 of a rear shaft 206 are different from those in the first embodiment. The other structure of the second embodiment is substantially the same as that of the writing tool 1 according to the first embodiment. In FIGS. 7 to 8C, the same parts as those of the first embodiment are shown by the same reference numerals, and detailed explanation thereof is omitted.

<Front Shaft>

The front shaft 205 is a tubular body, the both ends of which are opened. For example, the front shaft 205 can also be made of synthetic resin by an injection molding. A rear portion of the front shaft 205 forms the fitting part 251, which is configured to detachably fit to the fitted part 261 of an opening part of the rear shaft 206. As shown in FIGS. 7 and 8A, the fitting part 251 has: a smaller-diameter base 252 having a cylindrical shape; a first outward-facing pressure contact part 253*a* protruded radially from an outside surface of the smaller-diameter base 252; a second outward-facing pressure contact part 253*b* consisting of a cylindrical surface, which is smoothly continuous to the outside surface of the smaller-diameter base 252 and has the same curvature as that of the outside surface of the smaller-diameter base 252; and one slit 254 extending in parallel with the axial direction and penetrating the smaller-diameter base 252 in the radial direction. The first outward-facing pressure contact part 253*a* extends circumferentially (annularly except an area in which the slit 254 is provided). The slit 254 is formed in such a pattern that a position in the axial direction of a portion of the slit 254 is overlapped with a position in the axial direction of the first outward-facing pressure contact part 253*a* (the slit 254 is formed in such a pattern that the slit 254 lies across the first outward-facing pressure contact part 253*a*).

According to the above structure, when the smaller-diameter base 252 is inserted (press-fitted) into a larger-diameter base 262 (see FIG. 8B), the smaller-diameter base 252 can deform in such a manner that a width of the slit 254 can be narrowed, which can make the inserting operation smoother. On the other hand, after the smaller-diameter base 252 has been inserted (press-fitted) into the larger-diameter base 262, a resilient force is exerted to return the width of the slit 254, so that the first outward-facing pressure contact part 253*a* and a first inward-facing pressure contact part 263*a* (see FIG. 8B) are brought into a pressure contact radially with each other with a sufficient force. Thereby, setting and maintenance of an appropriate fitting force for detachably connecting (fitting) the front shaft 205 to the rear shaft 206 is relatively easy.

In the present embodiment, the second outward-facing pressure contact part 253*b* is provided on the rear side of the first outward-facing pressure contact part 253*a* (closer to a distal end of the smaller-diameter base 252). In addition, the front shaft 205 has a step part 255, which is configured to abut with the opening part of the rear shaft 206.

As a specific dimensional example, the length of the smaller-diameter base 252 (the length measured from the step part 255) may be 15 mm, the inner diameter of the smaller-diameter base 252 may be φ 7.2 mm, and the outer diameter of the smaller-diameter base 252 may be φ 8.8 mm. The length of the slit 254 may be 8 mm, and the width of the slit 254 may be uniform and 1 mm. The first outward-facing pressure contact part 253*a* may be formed circumferentially (annularly except the area in which the slit 254 is provided) as a protruded part (whose height is 0.15 mm), which may have an arc-shaped cross section, in an area of 9.8 mm to 11.2 mm from the step part 255 in the axial direction.

<Rear Shaft>

The rear shaft 206, which is configured to be detachably connected to the rear portion of the front shaft 205, is a bottomed cylindrical body consisting of a bottom wall and a surrounding side wall, wherein a front end thereof is opened and a rear end thereof is closed. For example, the rear shaft 206 can also be made of synthetic resin (such as polypropylene) by an injection molding.

As shown in FIG. 8B, the fitted part 261 has: a larger-diameter base 262 having a cylindrical shape (strictly speaking, whose inner diameter is changed to form a step on the way in the axial direction), whose diameter is larger than that of the smaller-diameter base 252 and into which the smaller-diameter base 252 is configured to be inserted; a first inward-facing pressure contact part 263*a* protruded radially from an inside surface of the larger-diameter base 262; and a second inward-facing pressure contact part 263*b* protruded radially from the inside surface of the larger-diameter base 262 similarly to the first inward-facing pressure contact part 263*a*.

In the present embodiment, the second inward-facing pressure contact part 263*b* is provided on the rear side of the first inward-facing pressure contact part 263*a*.

In addition to the function that the first outward-facing pressure contact part 253*a* and the first inward-facing pressure contact part 263*a* are brought into a pressure contact radially with each other with a sufficient force, due to another function that the second outward-facing pressure contact part 253*b* and the second inward-facing pressure contact part 263*b* are also brought into a pressure contact radially with each other, the front shaft 205 and the rear shaft 206 are connected without "rattling" in the radial direction. In addition, according to the second embodiment, as shown in FIG. 7, due to further another function that the first outward-facing pressure contact part 253*a* and the first inward-facing pressure contact part 263*a* are engaged (locked) with each other in the axial direction (serve as an outward-facing engaging part and an inward-facing engaging part), the front shaft 205 and the rear shaft 206 are connected without "rattling" in the axial direction as well. Thus, a stable writing performance with a good writing taste (writing feeling) can be achieved.

In addition, in the second embodiment as well, the second outward-facing pressure contact part 253*b* is provided at a position proximally (forwardly) away from the distal end of the smaller-diameter base 252 by a predetermined distance. Thus, the outside surface of the fitting part 251 (the outside surface of the smaller-diameter base 252) and the inside surface of the distal end of the rear shaft 206 (the inside surface of the larger-diameter base 262) are not in contact radially with each other, at a distal end area of the smaller-diameter base 252, when the front shaft 205 and the rear shaft 206 are fitted to each other.

That is to say, according to the second embodiment, high dimensional precision for the smaller-diameter base 252 is not necessary except for the first outward-facing pressure contact part 253*a* and the second outward-facing pressure contact part 253*b*. Thus, the setting and maintenance of the appropriate fitting force for detachably connecting the front shaft 205 to the rear shaft 206 is further facilitated. In addition, productivity of the parts (the front shaft 205 and the rear shaft 206) is also improved. Furthermore, in general, the shape or outer diameter of the outside surface of the rear shaft 206 is stable, so that an assured air-tight performance and fitting force can be achieved when the inside surface of the cap 2 and the outside surface of the rear shaft 206 are fitted to each other.

In addition, according to the second embodiment, when the front shaft 205 and the rear shaft 206 are fitted to each other, the opening part of the rear shaft 206 and the step part 255 are abutted with each other, the first outward-facing pressure contact part 253*a* and the first inward-facing pressure contact part 263*a* are engaged with each other in the axial direction and are brought into pressure contact with each other in the radial direction, and the second outward-facing pressure contact part 253*b* and the second inward-facing pressure contact part 263*b* are also brought into pressure contact with each other in the radial direction. Thereby, the front shaft 205 and the rear shaft 206 are fitted at their appropriate engagement positions. Thus, an appropriate fitting force for detachably connecting the front shaft 205 to the rear shaft 206 can be achieved more surely. In addition, the user can easily recognize that the front shaft 205 and the rear shaft 206 have been normally connected.

Thus, the present embodiment can also give a user a sense of security in the fact that the front shaft 205 and the rear shaft 206 have been normally connected.

As a specific dimensional example, the inner diameter of the larger-diameter base 262 may be φ 9.2 mm (strictly speaking, φ 9.2 mm in an axial length of 5.5 mm on the distal end side and φ 8.9 on the rear side thereof (there is a step)), and the outer diameter of the larger-diameter base 262 may be φ 10.7 mm. The first inward-facing pressure contact part 263*a* may be formed circumferentially as a protruded part (whose protruded height is 0.15 mm), which may have an arc-shaped cross section, in an area of 3 mm to 4 mm from the distal end (front end) of the larger-diameter base 262 in the axial direction. The second inward-facing pressure contact part 263*b* may be formed circumferentially as a protruded part (whose protruded height is 0.15 mm), which may have an arc-shaped cross section, in an area of 9.8 mm to 11.2 mm from the distal end (front end) of the larger-diameter base 262 in the axial direction. The cap fitting part 265 may be formed as four protrusions (whose protruded height is 0.3 mm), each of which may have an arc-shaped cross section, in an area of 8.6 mm to 10.4 mm from the distal end of the larger-diameter base 262 in the axial direction, discretely at substantially regular circumferential intervals.

Third Embodiment

Figure 9A:
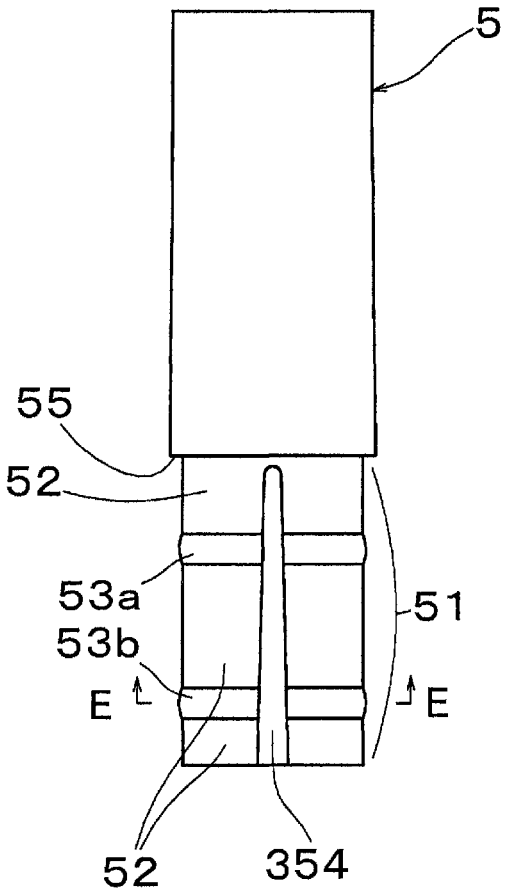
FIG. 9A is a front view of a front shaft in the third embodiment of the present invention.
Figure 9B:
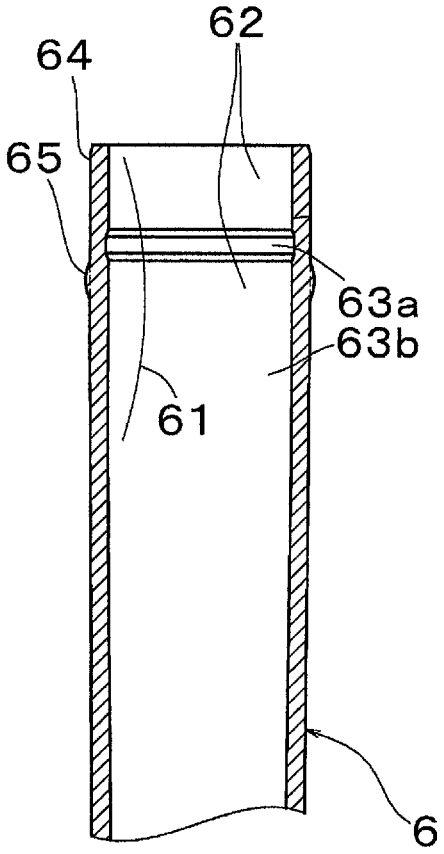
FIG. 9B is a longitudinal section view of a rear shaft in the third embodiment of the present invention.
Figure 9C:
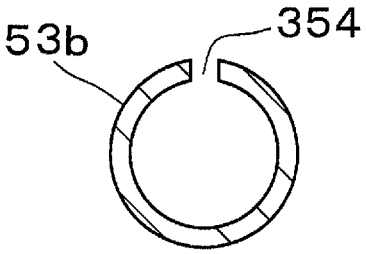
FIG. 9C is a cross section view taken along line E-E of FIG. 9A.

FIG. 9A is a front view of a front shaft in the third embodiment of the present invention. FIG. 9B is a longitudinal section view of a rear shaft in the third embodiment of the present invention. FIG. 9C is a cross section view taken along line E-E of FIG. 9A.

In the third embodiment of the present invention, the shape of a slit 354 is different from the first embodiment. Specifically, the slit 354 is tapered proximally from the distal end side of the smaller-diameter base 52. The other structure of the third embodiment is substantially the same as that of the writing tool 1 according to the first embodiment. In FIGS. 9A to 9C, the same parts as those of the first embodiment are shown by the same reference numerals, and detailed explanation thereof is omitted.

According to the third embodiment, when the smaller-diameter base 52 is inserted (press-fitted) into the larger-diameter base 62, a relatively wide portion of the slit 354 on the distal end side is used. On the other hand; after the smaller-diameter base 52 has been inserted (press-fitted) into the larger-diameter base 62, because of a relatively narrow portion of the slit 354 on a proximal side, high rigidity against a bending force is provided. In addition, when such a shape of the slit 354 is adopted, the front shaft can be manufactured by means of a slidable mold, which can reduce the manufacturing costs thereof.

As a specific dimensional example, the length of the slit 354 may be 14.5 mm, and the width of the slit 354 may be 1.5 mm on the distal end side and may be tapered proximally with a taper angle of 2 degrees.

Fourth Embodiment

Figure 10A:
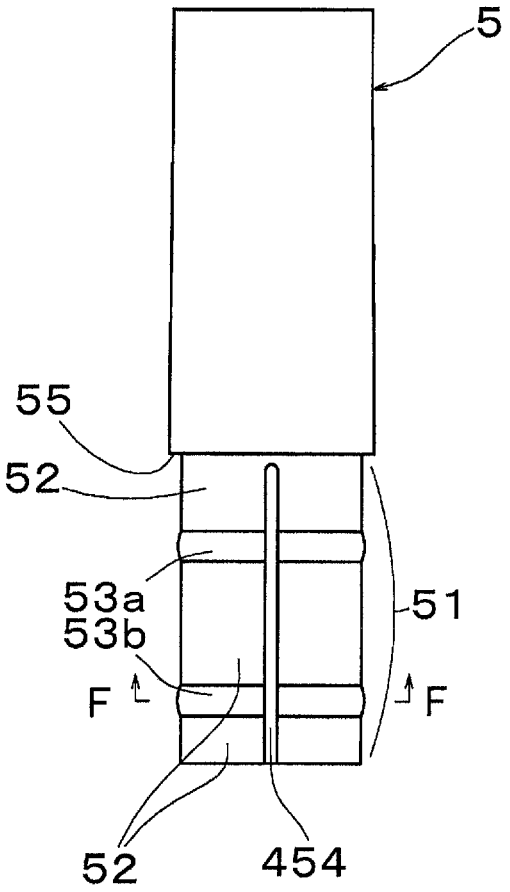
FIG. 10A is a front view of a front shaft in the fourth embodiment of the present invention.
Figure 10B:
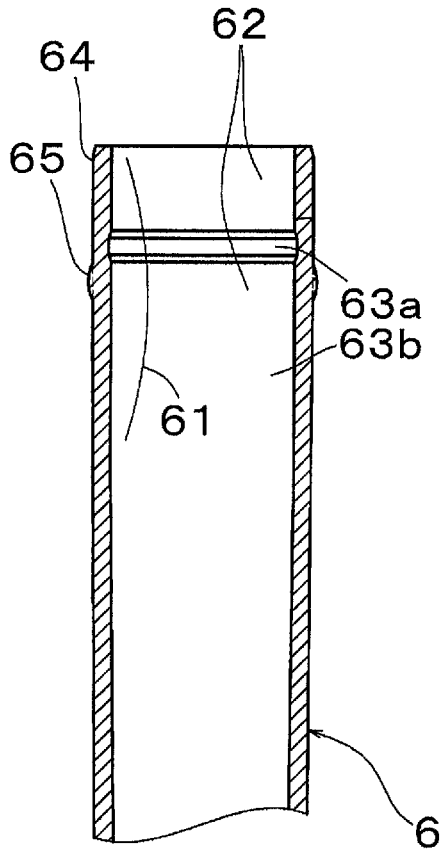
FIG. 10B is a longitudinal section view of a rear shaft in the fourth embodiment of the present invention.
Figure 10C:
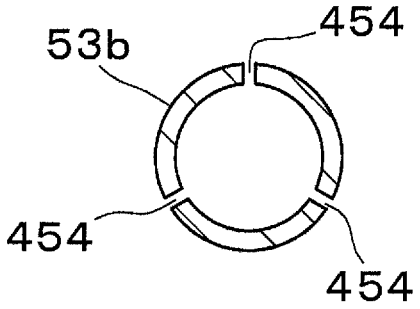
FIG. 10C is a cross section view taken along line F-F of FIG. 10A.

FIG. 10A is a front view of a front shaft in the fourth embodiment of the present invention. FIG. 10B is a longitudinal section view of a rear shaft in the fourth embodiment of the present invention. FIG. 10C is a cross section view taken along line F-F of FIG. 10A.

In the fourth embodiment of the present invention, the number of slits 454 and the shape of each slit 454 are different from the first embodiment. Specifically, as shown in FIG. 100, three slits 454 are provided at substantially regular circumferential intervals, and the width of each slit 454 is narrower than the width of the slit 54 according to the first embodiment. The other structure of the fourth embodiment is substantially the same as that of the writing tool 1 according to the first embodiment. In FIGS. 10A to 100, the same parts as those of the first embodiment are shown by the same reference numerals, and detailed explanation thereof is omitted.

According to the fourth embodiment, although the width of each slit 454 is narrower, an amount of flexural deformation as a whole of the small-diameter base 52 is secured. Thus, the operability in inserting the small-diameter base 52 into the large-diameter base 62 can be maintained high. In addition, when the width of each slit 454 is narrowed, rigidity against a bending force is made higher.

As a specific dimensional example, the length of the slit 454 may be 14.5 mm, and the width of the slit 454 may be uniform and 0.3 mm.

The number of the slits is not limited to three, but may be any odd number of three or more. On the other hand, when an even number of slits are arranged at substantially regular circumferential intervals, rigidity against a bending force in a direction aligned with opposite two slits may be made insufficient, which is not preferable.

Fifth Embodiment

Figure 11A:
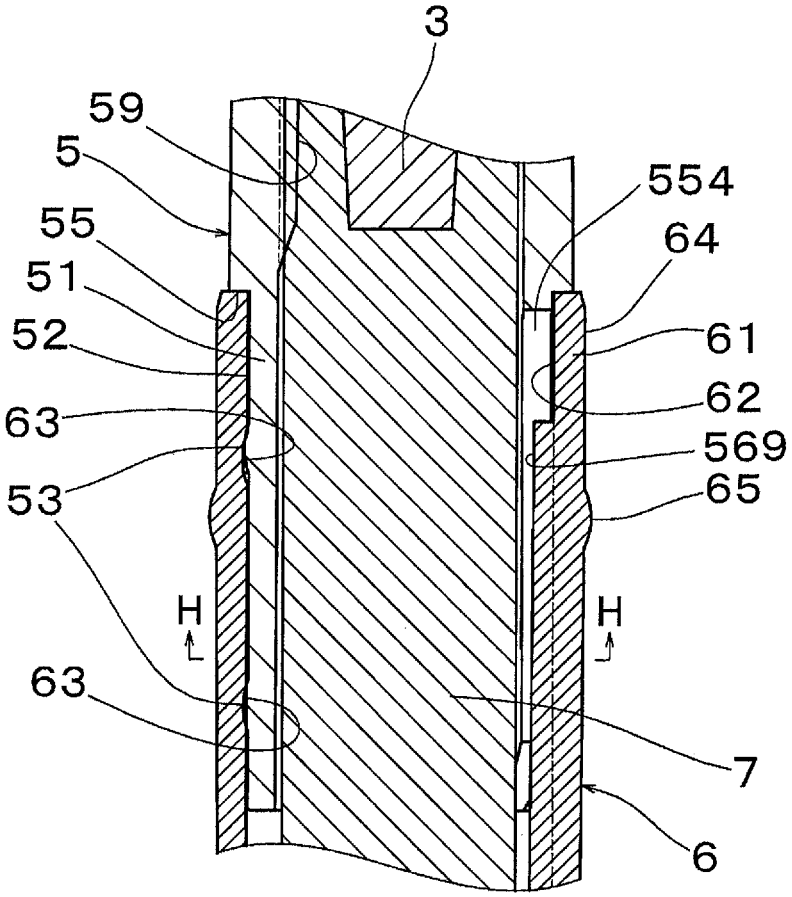
FIG. 11A is an enlarged longitudinal section view of a main part of the fifth embodiment of the present invention.
Figure 11B:
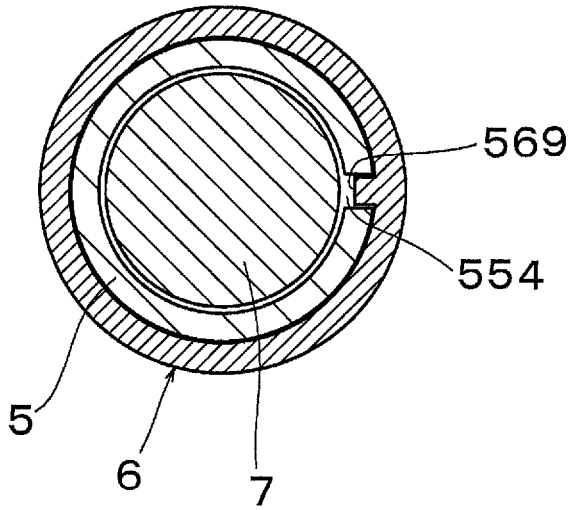
FIG. 11B is a cross section view taken along line H-H of FIG. 11A.
Figure 12A:
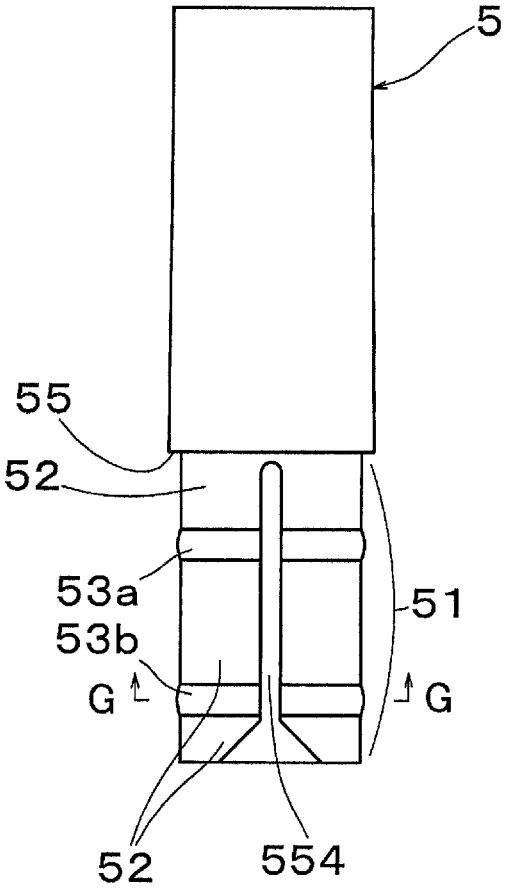
FIG. 12A is a front view of a front shaft in the fifth embodiment of the present invention.
Figure 12B:
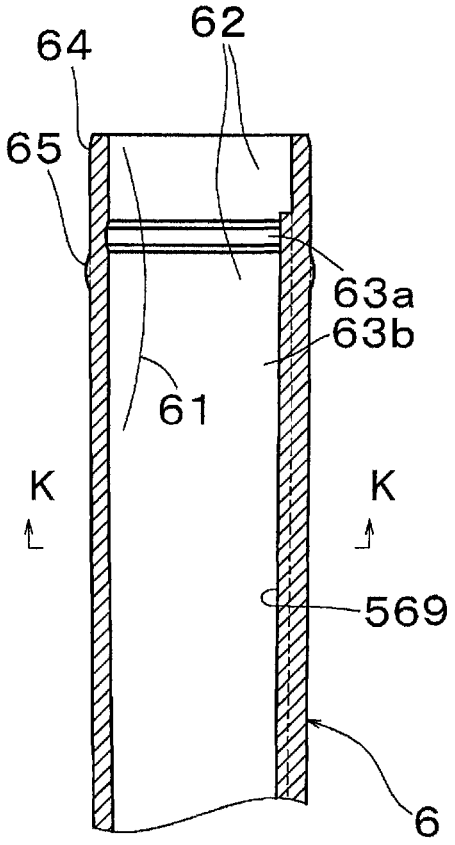
FIG. 12B is a longitudinal section view of a rear shaft in the fifth embodiment of the present invention.
Figure 12C:
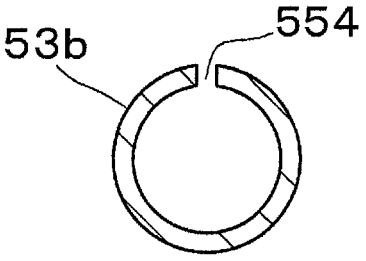
FIG. 12C is a cross section view taken along line G-G of FIG. 12A.
Figure 12D:
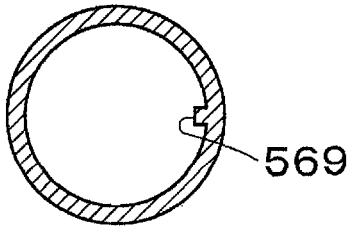
FIG. 12D is a cross section view taken along line K-K of FIG. 12B.

FIG. 11A is an enlarged longitudinal section view of a main part of the fifth embodiment of the present invention. FIG. 11B is a cross section view taken along line H-H of FIG. 11A. FIG. 12A is a front view of a front shaft in the fifth embodiment of the present invention. FIG. 12B is a longitudinal section view of a rear shaft in the fifth embodiment of the present invention. FIG. 12C is a cross section view taken along line G-G of FIG. 12A. FIG. 12D is a cross section view taken along line K-K of FIG. 12B.

In the fifth embodiment of the present invention, the shape of a slit 554 is different from the first embodiment. Specifically, the slit 554 is tapered proximally from the distal end side of the smaller-diameter base 52 to a rear end of the outward-facing pressure contact part 53*b*, and the width of the slit 554 on the proximal (front) side of the rear end of the outward-facing pressure contact part 53*b* is uniform. In addition, there is provided a rib 569, configured to be inserted into the slit 554, on the inside surface of the larger-diameter base 62.

The rib 569 extends in the axial direction rearward from a position slightly forward than the inward-facing engaging part 63*a* so that the rib 569 lies across the inward-facing engaging part 63*a*. The other structure of the fifth embodiment is substantially the same as that of the writing tool 1 according to the first embodiment. In FIGS. 11A to 12D, the same parts as those of the first embodiment are shown by the same reference numerals, and detailed explanation thereof is omitted.

According to the fifth embodiment, when the smaller-diameter base 52 is inserted (press-fitted) into the larger-diameter base 62 (see FIG. 12B), the smaller-diameter base 52 can deform in such a manner that the width of the slit 554 can be narrowed, which can make the inserting operation smoother. In addition, in the middle of the inserting operation, the rib 569 is inserted into the slit 554, which can make rigidity against a bending force remarkably high. Herein, since the distal end portion of the slit 554 is tapered (instead of being tapered, may be chamfered or rounded), the insertion of the rib 569 is smooth. After the smaller-diameter base 52 has been inserted (press-fitted) into the larger-diameter base 62, the outward-facing pressure contact part 53*b* and the inward-facing pressure contact part 63*b* are brought into a pressure contact radially with each other with a sufficient force. Thereby, the setting and maintenance of an appropriate fitting force for detachably connecting (fitting) the front shaft 5 to the rear shaft 6 is relatively easy.

In addition, according to the fifth embodiment, since the rib 569 is inserted into the slit 554, a function of preventing a relative rotation between the front shaft 5 and the rear shaft 6 can be added.

As a specific dimensional example, the length of the slit 554 may be 14.5 mm, and the width of the slit 554 may be 1 mm in a width-uniform area thereof, tapered with a taper angle of 90 degree, and 5 mm at the distal end thereof. The width of the rib 569 may be uniform and 1 mm, the protruded height of the rib 569 is uniform and 0.7 mm, and the position of a front end of the rib 569 may be 3 mm rearward than the position of a front end of the larger-diameter base 62.

Sixth Embodiment

Figure 13A:
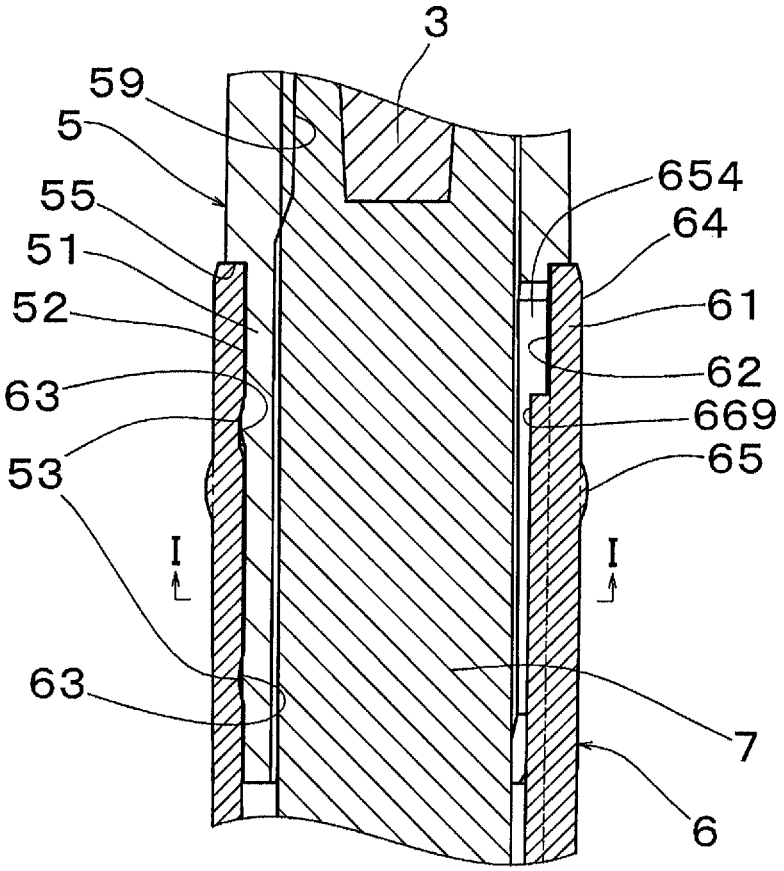
FIG. 13A is an enlarged longitudinal section view of a main part of the sixth embodiment of the present invention.
Figure 13B:
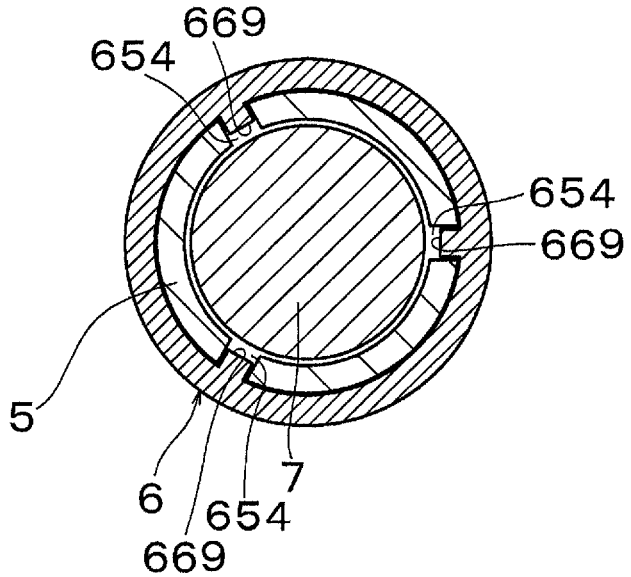
FIG. 13B is a cross section view taken along line I-I of FIG. 13A.
Figure 14A:
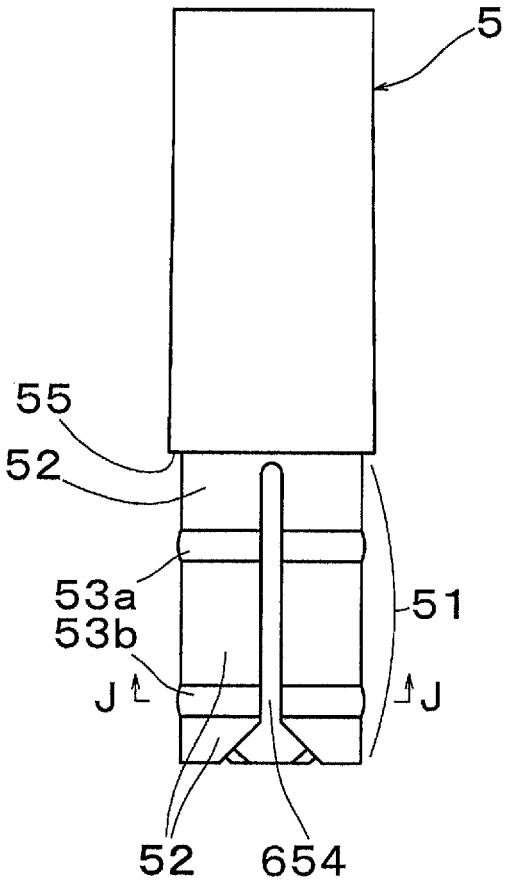
FIG. 14A is a front view of a front shaft in the sixth embodiment of the present invention.
Figure 14B:
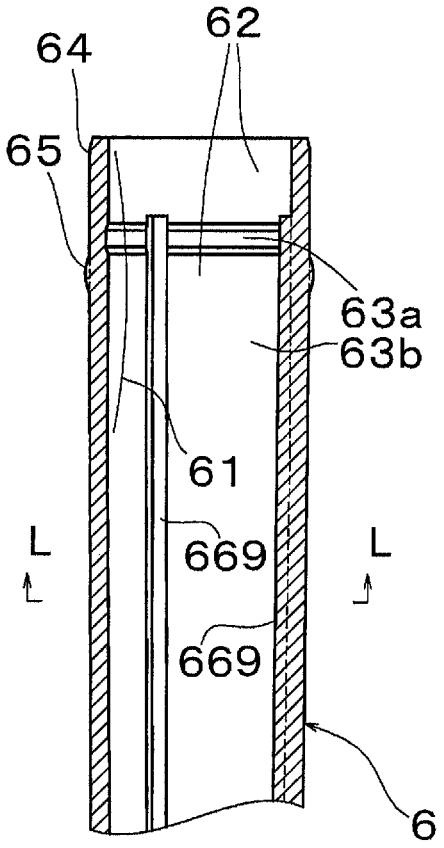
FIG. 14B is a longitudinal section view of a rear shaft in the sixth embodiment of the present invention.
Figure 14C:
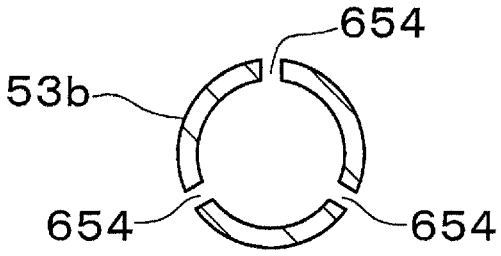
FIG. 14C is a cross section view taken along line J-J of FIG. 14A.
Figure 14D:
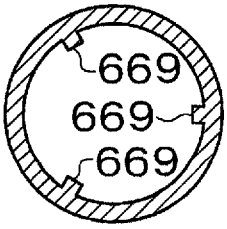
FIG. 14D is a cross section view taken along line L-L of FIG. 14B.

FIG. 13A is an enlarged longitudinal section view of a main part of the sixth embodiment of the present invention. FIG. 13B is a cross section view taken along line I-I of FIG. 13A. FIG. 14A is a front view of a front shaft in the sixth embodiment of the present invention. FIG. 14B is a longitudinal section view of a rear shaft in the sixth embodiment of the present invention. FIG. 14C is a cross section view taken along line J-J of FIG. 14A. FIG. 14D is a cross section view taken along line L-L of FIG. 14B.

In the sixth embodiment of the present invention, three slits 654 and three ribs 669 are provided, which is different from the fifth embodiment. Specifically, as shown in FIG. 14C, the three slits 654 are provided at substantially regular circumferential intervals, and as shown in FIG. 14D, the three ribs 669 are similarly provided at substantially regular circumferential intervals. The other structure of the sixth embodiment is substantially the same as that of the writing tool according to the fifth embodiment. In FIGS. 13A to 14D, the same parts as those of the fifth embodiment are shown by the same reference numerals, and detailed explanation thereof is omitted.

According to the sixth embodiment as well, when the smaller-diameter base 52 is inserted (press-fitted) into the larger-diameter base 62 (see FIG. 14B), the smaller-diameter base 52 can deform in such a manner that the width of each slit 654 can be narrowed, which can make the inserting operation smoother. In addition, in the middle of the inserting operation, each rib 669 is inserted into each corresponding slit 554, which can make rigidity against a bending force remarkably high. Herein, since the distal end portion of each slit 654 is tapered (instead of being tapered, it may be chamfered or rounded), the insertion of each rib 669 is smooth. After the smaller-diameter base 52 has been inserted (press-fitted) into the larger-diameter base 62, the outward-facing pressure contact part 53*b* and the inward-facing pressure contact part 63*b* are brought into a pressure contact radially with each other with a sufficient force. Thereby, the setting and maintenance of an appropriate fitting force for detachably connecting (fitting) the front shaft 5 to the rear shaft 6 is relatively easy.

In addition, according to the sixth embodiment as well, since the ribs 669 are inserted into the slits 654, a function of preventing a relative rotation between the front shaft 5 and the rear shaft 6 can be added.

As a specific dimensional example, the length of each slit 654 may be 14.5 mm, and the width of each slit 654 may be 1 mm in a width-uniform area thereof, tapered with a taper angle of 90 degree, and 5 mm at the distal end thereof. The width of each rib 669 may be uniform and 0.8 mm, the protruded height of each rib 669 is uniform and 0.7 mm, and the position of a front end of each rib 669 may be 3 mm rearward than the position of a front end of the larger-diameter base 62.

Seventh Embodiment

Figure 15A:
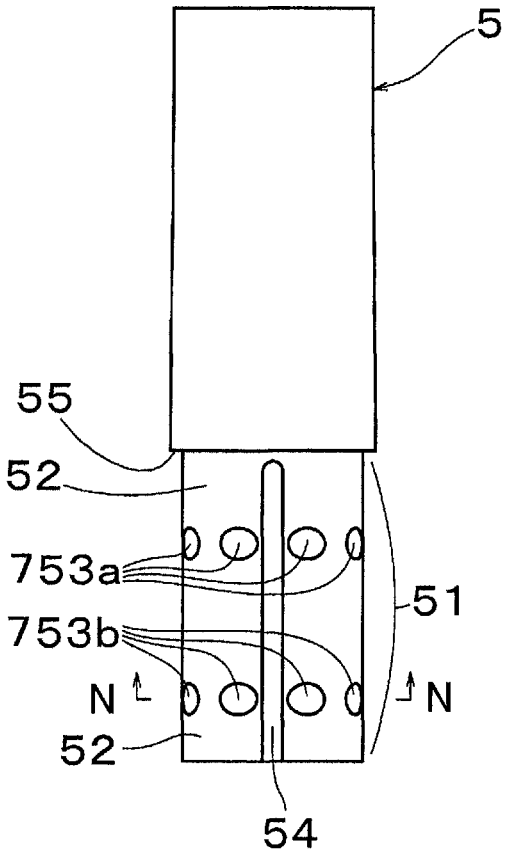
FIG. 15A is a front view of a front shaft in a seventh embodiment of the present invention.
Figure 15B:
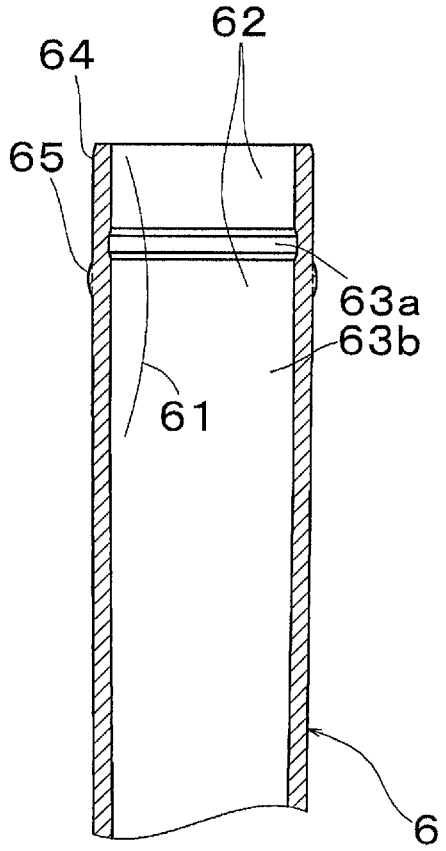
FIG. 15B is a longitudinal section view of a rear shaft in the seventh embodiment of the present invention.
Figure 15C:
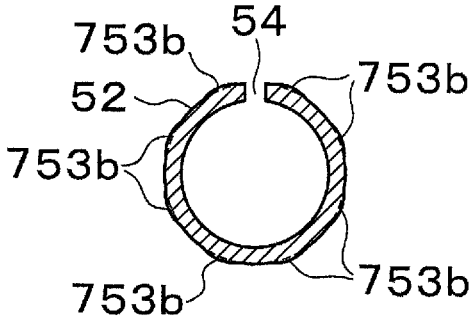
FIG. 15C is a cross section view taken along line N-N of FIG. 15A.

FIG. 15A is a front view of a front shaft in a seventh embodiment of the present invention. FIG. 15B is a longitudinal section view of a rear shaft in the seventh embodiment of the present invention. FIG. 15C is a cross section view taken along line N-N of FIG. 15A.

In the seventh embodiment of the present invention, an outward-facing engaging part 753*a* is formed as eight protrusions (whose protruded height from the smaller-diameter base 52 is 0.15 mm), each of which may have a substantially dome-like shape, in an area of 3.8 mm to 5.2 mm from the step part 55 in the axial direction, discretely at substantially regular circumferential intervals without being overlapped with the slit 54. In this manner as well, a position in the axial direction of a portion of the slit 54 is overlapped with a position in the axial direction of the outward-facing pressure contact part 753*b*. An outward-facing pressure contact part 753*b* is similarly formed as eight protrusions (whose protruded height from the smaller-diameter base 52 is 0.15 mm), each of which may have a substantially dome-like shape, in an area of 11.3 mm to 12.7 mm from the step part 55 in the axial direction, discretely at substantially regular circumferential intervals without being overlapped with the slit 54. The other structure of the seventh embodiment is substantially the same as that of the writing tool 1 according to the first embodiment. In FIGS. 15A to 15C, the same parts as those of the first embodiment are shown by the same reference numerals, and detailed explanation thereof is omitted.

According to the seventh embodiment as well, substantially the same effects as those of the first embodiment can be achieved. In particular, when the front shaft 5 and the rear shaft 6 are fitted to each other, the opening part of the rear shaft 6 and the step part 55 are abutted with each other, the outward-facing engaging part 753*a* and the inward-facing engaging part 63*a* (annular groove) are engaged with each other in the axial direction, and the outward-facing pressure contact part 753*b* and the inward-facing pressure contact part 63*b* (pressure contact surface) are brought into pressure contact with each other in the radial direction. Thus, the front shaft 5 and the rear shaft 6 are fitted at their appropriate engagement positions. Thereby, the appropriate fitting force for detachably connecting the front shaft 5 to the rear shaft 6 can be achieved more surely. In addition, the user can easily recognize that the front shaft 5 and the rear shaft 6 have been normally connected.

In addition, modifications explained for each of the third to sixth embodiments can be applied to the seventh embodiment as well.

EXPLANATION OF SIGN

1 writing tool
2 cap

21 annular sealing part
22 rear-shaft fitting part
3 pen tip
31 writing element
32 top part
33 front part
34 middle part
35 rear part
4 holding member
41 holding part
42 first contact wall
43*a* first rib
43*b* second rib
44 front edge
5 front shaft
51 fitting part
52 smaller-diameter base
53*a* outward-facing engaging part
53*b* outward-facing pressure contact part
54 slit
55 step part
56*a* second contact wall
56*b* third contact wall
57 longitudinal rib
58 holding-member fitting part
59 holding rib
6 rear shaft
61 fitted part
62 larger-diameter base
63*a* inward-facing engaging part
63*b* inward-facing pressure contact part
64 sealing part
65 cap fitting part
7 ink absorbent body
205 front shaft
206 rear shaft
251 fitting part
252 smaller-diameter base
253*a* first outward-facing pressure contact part
253*b* second outward-facing pressure contact part
254 slit
255 step part
261 fitted part
262 larger-diameter base
263*a* first inward-facing pressure contact part
263*b* second inward-facing pressure contact part
265 cap fitting part
354 slit
454 slit
554 slit
569 rib
654 slit
669 rib
753*a* outward-facing engaging part
753*b* outward-facing pressure contact part

What is claimed is:

1. A writing tool in which a front shaft is detachably provided on a rear shaft containing an ink absorbent body, and in which the ink absorbent body is configured to be replaced or replenished under a state in which the front shaft has been detached from the rear shaft, wherein one of a rear part of the front shaft and a front part of the rear shaft has:

a smaller-diameter base having a cylindrical shape and an insertion end, an outward-facing pressure contact part protruded radially from an outside surface of the smaller-diameter base, and at least one slit extending in parallel with an axial direction and penetrating the smaller-diameter base in a radial direction in such a pattern that a position in the axial direction of at least a portion of the slit is overlapped with a position in the axial direction of at least a portion of the outward-facing pressure contact part the slit extending to and forming an opening at the insertion end of the cylindrical shape, the other of the rear part of the front shaft and the front part of the rear shaft has:

a larger-diameter base having a cylindrical shape whose diameter is larger than that of the smaller-diameter base, into which the insertion end of the smaller-diameter base is configured to be inserted, and an inward-facing pressure contact part as a cylindrical inner surface provided on an inside surface of the larger-diameter base, and the outward-facing pressure contact part and the inward-facing pressure contact part are configured to be brought into a pressure contact radially with each other when the rear part of the front shaft and the front part of the rear shaft are fitted to each other, the smaller-diameter base has an outward-facing engaging part spaced apart from the outward-facing pressure contact part in the axial direction, the larger-diameter base has an inward-facing engaging part spaced apart from the inward-facing pressure contact part in the axial direction, and the outward-facing engaging part and the inward-facing engaging part are engaged with each other with respect to the axial direction when the rear part of the front shaft and the front part of the rear shaft are fitted to each other.

2. The writing tool according to claim 1, wherein the outward-facing pressure contact part extends circumferentially except an area in which the slit is provided.

3. The writing tool according to claim 1, wherein the outward-facing pressure contact part is provided at a position proximally away from a distal end of the smaller-diameter base by a predetermined distance, and the outside surface of the smaller-diameter base and the inside surface of the larger-diameter base are not in contact radially with each other, at a distal end area of the smaller-diameter base, when the rear part of the front shaft and the front part of the rear shaft are fitted to each other.

4. The writing tool according to claim 1, wherein the outward-facing pressure contact part extends circumferentially except an area in which the slit is provided, the inward-facing pressure contact part extends circumferentially such that the inward-facing pressure contact part is configured to be brought into a pressure contact radially with the outward-facing pressure contact part, the outward-facing engaging part extends circumferentially except an area in which the slit is provided, and the inward-facing engaging part extends circumferentially such that the inward-facing engaging part is configured to be engaged with the outward-facing engaging part with respect to the axial direction.

5. The writing tool according to claim 4, wherein the inward-facing engaging part is radially concavely provided on the inside surface of the larger-diameter base, and the inward-facing pressure contact part consists of a cylindrical surface which is smoothly continuous to the inside surface of the larger-diameter base and has the same curvature as that of the inside surface of the larger-diameter base.

6. The writing tool according to claim 1, wherein the outward-facing pressure contact part and the inward-facing pressure contact part are configured to be engaged with each other with respect to the axial direction when the rear part of the front shaft and the front part of the rear haft are fitted to each other.

7. The writing tool according to claim 1, further comprising a cap configured to cover the front shaft when the writing tool is not used for writing, and a portion of an inside surface of the cap is configured to be brought into a close contact with an entire circumference of a portion of an outside surface of the rear shaft.

8. The writing tool according to claim 1, wherein when the front shaft is detached from the rear shaft, the ink absorbent body is also detached from the rear shaft and held in the front shaft.

9. The writing tool according to claim 1, wherein the slit is tapered proximally from the distal end side of the smaller-diameter base.

10. The writing tool according to claim 1, wherein the number of the slits is an odd number of three or more, and the slits are provided at substantially regular circumferential intervals.

11. The writing tool according to claim 1, wherein a rib configured to be inserted into the slit is provided on the inside surface of the larger-diameter base.

* * * * *